US006830321B2

(12) United States Patent
Okamoto et al.

(10) Patent No.: US 6,830,321 B2
(45) Date of Patent: Dec. 14, 2004

(54) LIQUID TANK AND MANUFACTURE METHOD THEREFOR, INK JET APPARATUS AND MANUFACTURE METHOD THEREFOR, AND HEAD CARTRIDGE AND IMAGE FORMING APPARATUS

(75) Inventors: Hideaki Okamoto, Kanagawa (JP); Hiroshi Netsu, Kanagawa (JP)

(73) Assignee: Canon Kabsuhiki Kaisha, Tokyo (JP)

( * ) Notice: Subject to any disclaimer, the term of this patent is extended or adjusted under 35 U.S.C. 154(b) by 183 days.

(21) Appl. No.: 10/029,244

(22) Filed: Dec. 28, 2001

(65) Prior Publication Data

US 2002/0101489 A1 Aug. 1, 2002

(30) Foreign Application Priority Data

| | | |
|---|---|---|
| Dec. 28, 2000 | (JP) | 2000-403338 |
| Oct. 25, 2001 | (JP) | 2001-328301 |
| Dec. 7, 2001 | (JP) | 2001-374843 |

(51) Int. Cl.[7] ..... B41J 2/175
(52) U.S. Cl. ..... 347/86
(58) Field of Search ..... 347/84, 85, 86, 347/87; 220/256, 303; 215/261

(56) References Cited

U.S. PATENT DOCUMENTS

| | | | | |
|---|---|---|---|---|
| 3,953,862 | A | 4/1976 | Amberntsson et al. | 347/87 |
| 4,313,124 | A | 1/1982 | Hara | 346/140 R |
| 4,345,262 | A | 8/1982 | Shirato et al. | 346/140 R |
| 4,459,600 | A | 7/1984 | Sato et al. | 346/140 R |
| 4,463,359 | A | 7/1984 | Ayata et al. | 346/1.1 |
| 4,558,333 | A | 12/1985 | Sugitani et al. | 346/140 R |
| 4,723,129 | A | 2/1988 | Endo et al. | 346/1.1 |
| 4,740,796 | A | 4/1988 | Endo et al. | 346/1.1 |
| 5,603,900 | A | 2/1997 | Clark et al. | 422/101 |
| 5,657,891 | A | 8/1997 | Bilani et al. | 220/256 |
| 5,663,754 | A | 9/1997 | Lorenze, Jr. et al. | 347/87 |
| 5,752,629 | A | 5/1998 | Hardy | 222/189.09 |
| 6,095,401 | A | 8/2000 | Bush | 228/110.1 |
| 6,447,084 | B1 | 9/2002 | Uetsuki et al. | 347/7 |
| 6,474,797 | B2 | 11/2002 | Kurata et al. | 347/85 |
| 6,540,321 | B1 | 4/2003 | Hirano et al. | 347/22 |
| 6,629,758 | B2 | 10/2003 | Okamoto et al. | 347/85 |
| 2001/0037629 | A1 | 11/2001 | Mashiko et al. | 55/385.1 |
| 2001/0045976 | A1 | 11/2001 | Ara et al. | 347/85 |

FOREIGN PATENT DOCUMENTS

| | | |
|---|---|---|
| DE | 19715263 | 10/1998 |
| DE | 19832168 | 1/2000 |
| EP | 312924 | 4/1989 |
| EP | 1057644 | 12/2000 |
| EP | 1142719 | 10/2001 |
| JP | 54-56847 | 5/1979 |
| JP | 59-123670 | 7/1984 |
| JP | 59-138461 | 8/1984 |
| JP | 60-71260 | 4/1985 |
| JP | 5-201021 | 8/1993 |
| JP | 9-295406 | 11/1997 |
| JP | 2000-326527 | 11/2000 |

*Primary Examiner*—Anh T. N. Vo
(74) *Attorney, Agent, or Firm*—Fitzpatrick, Cella, Harper & Scinto

(57) ABSTRACT

A liquid tank according to the present invention comprises negative-pressure introducing sections for introducing negative pressure into the liquid tank, a liquid intake section for taking a liquid in the liquid tank on the basis of the negative pressure introduced by the negative-pressure introducing sections, an atmosphere communication port that is closed when the liquid is introduced through the liquid intake section, and a gas-liquid separating element disposed in the negative-pressure introducing sections so as to pass through only a gas. The gas-liquid separating element has a joined portion formed at least on the outer periphery of the gas-liquid separating element and joined to he negative-pressure introducing sections, and a ventilation area that contributes to ventilation.

24 Claims, 25 Drawing Sheets

LIQUID TANK AND MANUFACTURE METHOD THEREFOR, INK JET APPARATUS AND MANUFACTURE METHOD THEREFOR, AND HEAD CARTRIDGE AND IMAGE FORMING APPARATUS

This application is based on Japanese Patent Application Nos. 2000-403338 filed Dec. 28, 2000, 2001-328301 filed Oct. 25, 2001 and 2001-374843 filed Dec. 7, 2001, the content of which is incorporated hereinto by reference.

BACKGROUND OF THE INVENTION

1. Field of the Invention

The present invention relates to a structure, a liquid tank for storing ink used to form images on a print medium and a treatment liquid used to orient the print property of ink on the print medium, manufacture methods for the structure and the liquid tank, a head cartridge incorporating this liquid tank, and an ink jet apparatus and an image forming apparatus which use this liquid tank.

In this specification, a word "print" refers to not only forming a significant information, such a characters and figures, but also forming an image, designs or patterns on the printing medium and processing such as etching and so forth in the printing medium, whether the information is significant or insignificant or whether it is visible so as to be perceived by humans.

The term "printing medium" includes not only paper used in common printing apparatus, but also sheet materials such as cloths, plastic films, metal sheets, glass plates, ceramic sheets, wood panels and leathers or three-dimensional materials such as spheres, round pipes and so forth that can receive the ink.

Further, the word "ink" should be interpreted in its wide sense as with the word "print", refers to liquid that is applied to the printing medium for forming images, designs or patterns, processing such as etching in the printing medium or processing such as coagulating or insolubilizing a colorant in the ink and includes any liquids used for printing.

2. Description of the Prior Art

For example, Japanese Patent Application Laid-open No. 5-201021 proposes a technique of preventing the leakage of ink from an ink tank of an ink jet printer using a gas-liquid separating element for an atmosphere communication port, the gas-liquid separating element consisting of fluoroplastic and so forth. According to this method, a joined portion of the gas-liquid separating element is heated from the interior of the ink tank to fuse the gas-liquid separating element on a wall surface of the ink tank.

However, thermal fusion requires the gas-liquid separating element to be heated at a temperature close to the melting point of polypropylene or the like, and this heat may degrade the liquid repellency of the gas-liquid separating element, so that the ink is likely to remain in a ventilation area of the gas-liquid separating element, thereby hindering ventilation.

Further, if to prevent the adverse effects of heat, ultrasonic vibration is imparted to an interface to cause friction for bonding, the vibration may be transmitted to the ventilation area of the gas-liquid separating element during fusion to stretch this area, thereby degrading the liquid repellency.

SUMMARY OF THE INVENTION

It is an object of the present invention to provide a structure that serves to maintain the liquid repellency of a gas-liquid separating element and a manufacture method therefor, a liquid tank conforming to this structure and a manufacture method therefor, an ink jet apparatus using this liquid tank and a manufacture method thereof, and a head cartridge using this liquid tank and a manufacture method therefor.

A first aspect of the present invention is in a structure comprising a communication section for providing communication between an interior and an exterior, and a gas-liquid separating element for passing through only a gas, the gas-liquid separating element being disposed in the communication section, the structure being characterized in that the gas-liquid separating element has a joined portion formed at least on an outer periphery of the gas-liquid separating element and joined to the communication section, and a ventilation area that contributes to ventilation. According to the present invention, the liquid repellency of the ventilation area can be appropriately maintained.

In the first aspect of the present invention, the gas-liquid separating element may further have a non-joined portion between the joined portion and the ventilation area. In this case, the non-joined area may be a non-heated area. If the non-joined area is provided between the joined portion and the ventilation area of the gas-liquid separating element, it serves to reduce the adverse effects of the jointed portion on the ventilation area, thereby more appropriately maintaining the liquid repellency of the ventilation area. In particular, if the non-joined area is a non-heated area, even if the joined portion is a thermally bonded portion, the presence of the non-joined area, which is not heated, protects the ventilation area of the gas-liquid separating element from thermal adverse effects, thereby more appropriately maintaining the liquid repellency of the gas-liquid separating element.

The joined portion may be the thermally bonded portion. In this case, the gas-liquid separating element can be reliably joined to the communication portion.

The second aspect of the present invention is in a structure characterized by comprising a communication section for providing communication between an interior and an exterior, a gas-liquid separating element for passing through only a gas, the gas-liquid separating element being disposed in the communication section, and an adhesive layer for joining the gas-liquid separating element and the communication section, the adhesive layer being formed between the gas-liquid separating element and the communication section. According to the present invention, the gas-liquid separating element need not be heated at high temperature, and its liquid repellency can thus be more appropriately maintained.

In the second aspect of the present invention, an adhesive constituting the adhesive layer may be a thermosetting adhesive that is hardened at a temperature at which the gas-liquid separating element is not thermally adversely affected. Alternatively, the adhesive may be a hot-melt adhesive that is melted at a temperature at which the gas-liquid separating element is not thermally adversely affected. If such a thermosetting adhesive or hot-melt adhesive is used, the gas-liquid separating element can be reliably fixed to the communication section without degrading the liquid repellency of the gas-liquid separating element.

The third aspect of the present invention is in a structure characterized by comprising a communication section for providing communication between an interior and an exterior, a gas-liquid separating element for passing through only a gas, the gas-liquid separating element being disposed in the communication section, and a holding member for holding at least an outer periphery of the gas-liquid separating element between the holding member and the communication section, the holding member being attached to the communication section. According to the present invention, the gas-liquid separating element need not be heated at high temperature, and its liquid repellency can thus be more appropriately maintained.

In the structures according to any one of the first to third aspects of the present invention, the gas-liquid separating element may be composed of PTFE. In this case, the gas-liquid separating element may undergo liquid repellency treatment. If the gas-liquid separating element comprises PTFE, which is chemically stable and fine resist heat, liquid repellency treatment specifically enables the liquid repellency of the gas-liquid separating element to be appropriately maintained for a long time.

The fourth aspect of the present invention is in a method for manufacturing a structure comprising a communication section for providing communication between an interior and an exterior, and a gas-liquid separating element for passing through only a gas, the gas-liquid separating element being disposed in the communication section, the method being characterized by comprising the step of heating the gas-liquid separating element from a surface thereof which is opposite a surface thereof which faces the exterior to thermally bond at least an outer periphery of the gas-liquid separating element on the communication section. According to the present invention, the deterioration of the liquid repellency of the gas-liquid separating element can be minimized.

The fifth aspect of the present invention is in a method for manufacturing a structure comprising a communication section for providing communication between an interior and an exterior, and a gas-liquid separating element for passing through only a gas, the gas-liquid separating element being disposed in the communication section, the method being characterized by comprising the steps of thermally bonding at least an outer periphery of the gas-liquid separating element on the communication section using an annular thermal fusion head, and during the thermal fusion step, sucking air from an interior of the thermal fusion head. According to the present invention, the thermal adverse effects on a ventilation area of the gas-liquid separating element can be suppressed to further restrain the deterioration of the liquid repellency thereof.

The sixth aspect of the present invention is in a method for manufacturing a structure comprising a communication section for providing communication between an interior and an exterior, and a gas-liquid separating element for passing through only a gas, the gas-liquid being disposed in the communication section, the method being characterized by comprising the steps of thermally bonding at least an outer periphery of the gas-liquid separating element on the communication section using an annular thermal fusion head, and during the thermal fusion step, covering a ventilation area of the gas-liquid separating element and a periphery thereof with a heat insulating member. According to the present invention, the thermal adverse effects on the ventilation area of the gas-liquid separating area can be suppressed to further restrain the deterioration of the liquid repellency thereof.

The seventh aspect of the present invention is in a method for manufacturing a structure comprising a communication section for providing communication between an interior and an exterior, and a gas-liquid separating element for passing through only a gas, the gas-liquid separating element being disposed in the communication section, the method being characterized by comprising the steps of pressing an annular thermal fusion head against the communication section via the gas-liquid separating element, and after pressing the thermal fusion head at least against an outer periphery of the gas-liquid separating element, heating only a tip portion of the thermal fusion head to thermally bond at least the outer periphery of the gas-liquid separating element on the communication section. According to the present invention, the thermal adverse effects on the ventilation area of the gas-liquid separating area can be minimized to restrain the deterioration of the liquid repellency thereof.

In the seventh aspect of the present invention, a heater may be incorporated in a tip portion of a thermal fusion head that comes into contact with the gas-liquid separating element. In this case, when an outer peripheral portion of the gas-liquid separating element is thermally bonded on the communication portion, the thermal adverse effects on the ventilation area of the gas-liquid separating element can be minimized.

The eighth aspect of the present invention is in a method for manufacturing a structure comprising a communication section for providing communication between an interior and an exterior, and a gas-liquid separating element for passing through only a gas, the gas-liquid separating element being disposed in the communication section, the method being characterized by comprising the step of thermally bonding at least an outer periphery of the gas-liquid separating element on the communication section using a laser. According to the present invention, the thermal adverse effects on the ventilation area, located in the center of the gas-liquid separating element, can be minimized to restrain the deterioration of the liquid repellency thereof.

The ninth aspect of the present invention is in a method for manufacturing a structure comprising a communication section for providing communication between an interior and an exterior, and a gas-liquid separating element for passing through only a gas, the gas-liquid separating element disposed in the communication section, the method being characterized by comprising the step of fusing at least an outer periphery of the gas-liquid separating element by ultrasonic bonding while holding at least part of a ventilation area of the gas-liquid separating element using vibration isolating means. According to the present invention, the ventilation area of the gas-liquid separating element is substantially prevented from being stretched owing to vibration.

In the method for manufacturing the structure according to any one of the fourth to ninth aspects of the present invention, the gas-liquid separating element may be composed of PTFE. In this case, the gas-liquid separating element may undergo liquid repellency treatment. If the gas-liquid separating element comprises PTFE, which is chemically stable and fine resist heat, liquid repellency treatment specifically enables the liquid repellency of the gas-liquid separating element to be appropriately maintained for a long time.

A tenth aspect of the present invention is in a structure characterized by being formed using a manufacture method for a structure according to any one of the fourth to ninth aspects of the present invention. According to the present invention, appropriate liquid repellency is maintained in the ventilation area of the gas-liquid separating element joined to the communication portion.

An eleventh aspect of the present invention is in a liquid tank comprising a negative-pressure introducing section for introducing negative pressure into the liquid tank, a liquid intake section for taking a liquid in the liquid tank on the basis of the negative pressure introduced by the negative-pressure introducing section, and a gas-liquid separating element for passing through only a gas, the gas-liquid separating element being disposed in the negative-pressure introducing section, the liquid tank being characterized in that the gas-liquid separating element has a joined portion formed at least on an outer periphery of the gas-liquid separating element and joined to the negative-pressure introducing section, and a ventilation area that contributes to ventilation. According to the present invention, the liquid repellency of the ventilation area can be appropriately maintained.

The twelfth aspect of the present invention is in a liquid tank comprising a container body for storing a liquid, an opening through which the liquid is taken out, an atmosphere communication port for providing communication between the container body and the air, and gas-liquid separating element for passing through only a gas, the gas-liquid separating element being disposed in the atmosphere communication port, the liquid tank being characterized in that the gas-liquid separating element has a joined portion formed at least on an outer periphery of the gas-liquid separating element and joined to the atmosphere communication port, and a ventilation area that contributes to ventilation. According to the present invention, the liquid repellency of the ventilation area can be appropriately maintained.

In the ink tank according to the eleventh or twelfth aspects of the present invention, the gas-liquid separating element may further have a non-joined portion between the joined portion and the ventilation area. In this case, the non-joined area may be a non-heated area. If the non-joined area is provided between the joined portion and the ventilation area of the gas-liquid separating element, it serves to reduce the adverse effects of the jointed portion on the ventilation area, thereby more appropriately maintaining the liquid repellency of the ventilation area. In particular, if the non-joined area is a non-heated area, even if the joined portion is a thermally bonded portion, the presence of the non-joined area, which is not heated, protects the ventilation area of the gas-liquid separating element from thermal adverse effects, thereby more appropriately maintaining the liquid repellency of the gas-liquid separating element.

The joined portion may be the thermally bonded portion. In this case, the gas-liquid separating element can be reliably joined to the communication portion.

The thirteenth aspect of the present invention is in a liquid tank characterized by comprising a negative-pressure introducing section for introducing negative pressure into the liquid tank, a liquid intake section for taking a liquid in the liquid tank on the basis of the negative pressure introduced by the negative-pressure introducing section, a gas-liquid separating element for passing through only a gas, the gas-liquid separating element being disposed in the negative-pressure introducing section, and an adhesive layer for joining the gas-liquid separating element and the negative-pressure introducing section, the adhesive layer being formed between the gas-liquid separating element and the negative-pressure introducing section. According to the present invention, the gas-liquid separating element need not be heated at high temperature, and its liquid repellency can thus be more appropriately maintained.

The fourteenth aspect of the present invention is in a liquid tank characterized by comprising a container body for storing a liquid, an opening through which the liquid is taken out, an atmosphere communication port for providing communication between the container body and the air, a gas-liquid separating element for passing through only a gas, the gas-liquid separating element being disposed in the atmosphere communication port, and an adhesive layer for joining the gas-liquid separating element and the atmosphere communication port, the adhesive layer being formed between the gas-liquid separating element and the atmosphere communication port. According to the present invention, the gas-liquid separating element need not be heated at high temperature, and its liquid repellency can thus be more appropriately maintained.

In the ink tank according to the thirteenth or fourteenth aspects of the present invention, an adhesive constituting the adhesive layer may be a thermosetting adhesive that is hardened at a temperature at which the gas-liquid separating element is not thermally adversely affected. Alternatively, the adhesive may be a hot-melt adhesive that is melted at a temperature at which the gas-liquid separating element is not thermally adversely affected. If such a thermosetting adhesive or hot-melt adhesive is used, the gas-liquid separating element can be reliably fixed to the negative-pressure introducing section or the atmosphere communication port without degrading the liquid repellency of the gas-liquid separating element.

The fifteenth aspect of the present invention is in a liquid tank characterized by comprising a negative-pressure introducing section for introducing negative pressure into the liquid tank, a liquid intake section for taking a liquid in the liquid tank on the basis of the negative pressure introduced by the negative-pressure introducing section, a gas-liquid separating element for passing through only a gas, the gas-liquid separating element being disposed in the negative-pressure introducing section, and a holding member for holding at least an outer periphery of the gas-liquid separating element between the holding member and the negative-pressure introducing section, the holding member being attached to the negative-pressure introducing section. According to the present invention, the gas-liquid separating element need not be heated at high temperature, and its liquid repellency can thus be more appropriately maintained.

The sixteenth aspect of the present invention is in a liquid tank characterized by comprising a container body for storing a liquid, an opening through which the liquid is taken out, an atmosphere communication port for providing communication between the container body and the air, a gas-liquid separating element for passing through only a gas, the gas-liquid separating element being disposed in the atmosphere communication port, and a holding member for holding at least an outer periphery of the gas-liquid separating element between the holding member and the atmosphere communication port, the holding member being attached to the atmosphere communication port. According to the present invention, the gas-liquid separating element need not be heated at high temperature, and its liquid repellency can thus be more appropriately maintained.

In the ink tank according to any one of the eleventh to the sixteenth aspects of the present invention, the gas-liquid separating element may be composed of PTFE. In this case, the gas-liquid separating element may undergo liquid repellency treatment. If the gas-liquid separating element comprises PTFE, which is chemically stable and fine resist heat, liquid repellency treatment specifically enables the liquid repellency of the gas-liquid separating element to be appropriately maintained for a long time.

The liquid tank may store ink or a treatment liquid used to orient the print property of ink on a print medium. In this case, the liquid tank may be immediately used for an ink jet apparatus or an image forming apparatus.

The seventeenth aspect of the present invention is in a method for manufacturing a liquid tank comprising a negative-pressure introducing section for introducing negative pressure into the liquid tank, a liquid intake section for taking a liquid in the liquid tank on the basis of the negative pressure introduced by the negative-pressure introducing section, and a gas-liquid separating element for passing through only a gas, the gas-liquid separating element being disposed in the negative-pressure introducing section, the method being characterized by comprising the step of heating the gas-liquid separating element from a surface thereof which is opposite a surface thereof which faces the exterior to thermally bond at least an outer periphery of the gas-liquid separating element on the negative-pressure introducing section. According to the present invention, the deterioration of the liquid repellency of the gas-liquid separating element can be minimized.

The eighteenth aspect of the present invention is in a method for manufacturing a liquid tank comprising a container body for storing a liquid, an opening through which the liquid is taken out, an atmosphere communication port for providing communication between the container body and the air, and gas-liquid separating element for passing through only a gas, the gas-liquid separating element being disposed in the atmosphere communication port, the method being characterized by comprising the step of heating the gas-liquid separating element from a surface thereof which is opposite a surface thereof which faces the exterior to thermally bond at least an outer periphery of the gas-liquid separating element on the atmosphere communication port. According to the present invention, the thermal adverse effects on a ventilation area of the gas-liquid separating element can be suppressed to further restrain the deterioration of the liquid repellency thereof.

The nineteenth aspect of the present invention is in a method for manufacturing a liquid tank comprising a negative-pressure introducing section for introducing negative pressure into the liquid tank, a liquid intake section for taking a liquid in the liquid tank on the basis of the negative pressure introduced by the negative-pressure introducing section, and a gas-liquid separating element for passing through only a gas, the gas-liquid separating element being disposed in the negative-pressure introducing section, the method being characterized by comprising the steps of thermally bonding at least an outer periphery of the gas-liquid separating element on the negative-pressure introducing section using an annular thermal fusion head, and during the thermal fusion step, sucking air from an interior of the thermal fusion head. According to the present invention, the thermal adverse effects on a ventilation area of the gas-liquid separating element can be suppressed to further restrain the deterioration of the liquid repellency thereof.

The twentieth aspect of the present invention is in a method for manufacturing a liquid tank comprising a container body for storing a liquid, an opening through which the liquid is taken out, an atmosphere communication port for providing communication between the container body and the air, and gas-liquid separating element for passing through only a gas, the gas-liquid separating element being disposed in the atmosphere communication port, the method being characterized by comprising the steps of thermally bonding at least an outer periphery of the gas-liquid separating element on the atmosphere communication port using an annular thermal fusion head, and during the thermal fusion step, sucking air from an interior of the thermal fusion head. According to the present invention, the thermal adverse effects on a ventilation area of the gas-liquid separating element can be suppressed to further restrain the deterioration of the liquid repellency thereof.

The twenty-first aspect of the present invention is in a method for manufacturing a liquid tank comprising a negative-pressure introducing section for introducing negative pressure into the liquid tank, a liquid intake section for taking a liquid in the liquid tank on the basis of the negative pressure introduced by the negative-pressure introducing section, and a gas-liquid separating element for passing through only a gas, the gas-liquid separating element being disposed in the negative-pressure introducing section, the method being characterized by comprising the steps of thermally bonding at least an outer periphery of the gas-liquid separating element on the negative-pressure introducing section using an annular thermal fusion head, and during the thermal fusion step, covering a ventilation area of the gas-liquid separating element and a periphery thereof with a heat insulating member. According to the present invention, the thermal adverse effects on the ventilation area of the gas-liquid separating area can be minimized to restrain the deterioration of the liquid repellency thereof.

The twenty-second aspect of the present invention is in a method for manufacturing a liquid tank comprising a container body for storing a liquid, an opening through which the liquid is taken out, an atmosphere communication port for providing communication between the container body and the air, and gas-liquid separating element for passing through only a gas, the gas-liquid separating element being disposed in the atmosphere communication port, the method being characterized by comprising the steps of thermally bonding at least an outer periphery of the gas-liquid separating element on the atmosphere communication port using an annular thermal fusion head, and during the thermal fusion step, covering a ventilation area of the gas-liquid separating element and a periphery thereof with a heat insulating member. According to the present invention, the thermal adverse effects on the ventilation area of the gas-liquid separating area can be minimized to restrain the deterioration of the liquid repellency thereof.

The twenty-third aspect of the present invention is in a method for manufacturing a liquid tank comprising a negative-pressure introducing section for introducing negative pressure into the liquid tank, a liquid intake section for taking a liquid in the liquid tank on the basis of the negative pressure introduced by the negative-pressure introducing section, and a gas-liquid separating element for passing through only a gas, the gas-liquid separating element being disposed in the negative-pressure introducing section, the method being characterized by comprising the steps of pressing an annular thermal fusion head against the negative-pressure introducing section via the gas-liquid separating element, and after pressing the thermal fusion head at least against an outer periphery of the gas-liquid separating element, heating only a tip portion of the thermal fusion head to thermally bond at least the outer periphery of the gas-liquid separating element on the negative-pressure introducing section. According to the present invention, the thermal adverse effects on the ventilation area of the gas-liquid separating area can be minimized to restrain the deterioration of the liquid repellency thereof.

The twenty-fourth aspect of the present invention is in a method for manufacturing a liquid tank comprising a container body for storing a liquid, an opening through which the liquid is taken out, an atmosphere communication port for providing communication between the container body and the air, and gas-liquid separating element for passing through only a gas, the gas-liquid separating element being disposed in the atmosphere communication port, the method being characterized by comprising the steps of pressing an annular thermal fusion head against the atmosphere communication port via the gas-liquid separating element, and after pressing the thermal fusion head at least against an outer periphery of the gas-liquid separating element, heating only a tip portion of the thermal fusion head to thermally bond at least the outer periphery of the gas-liquid separating element on the atmosphere communication port. According to the present invention, the thermal adverse effects on the ventilation area of the gas-liquid separating area can be minimized to restrain the deterioration of the liquid repellency thereof.

In the method according to the twenty-third or the twenty-fourth aspects of the present invention, a heater may be incorporated in a tip portion of a thermal fusion head that comes into contact with the gas-liquid separating element. In this case, when an outer peripheral portion of the gas-liquid separating element is thermally bonded on the communication portion, the thermal adverse effects on the ventilation area of the gas-liquid separating element can be minimized.

The twenty-fifth aspect of the present invention is in a method for manufacturing a liquid tank comprising a negative-pressure introducing section for introducing negative pressure into the liquid tank, a liquid intake section for taking a liquid in the liquid tank on the basis of the negative pressure introduced by the negative-pressure introducing section, and a gas-liquid separating element for passing through only a gas, the gas-liquid separating element being disposed in the negative-pressure introducing section, the method being characterized by comprising the step of thermally bonding at least an outer periphery of the gas-liquid separating element on the negative-pressure introducing section using a laser. According to the present invention, the thermal adverse effects on the ventilation area of the gas-liquid separating area can be minimized to restrain the deterioration of the liquid repellency thereof.

The twenty-sixth aspect of the present invention is in a method for manufacturing a liquid tank comprising a container body for storing a liquid, an opening through which the liquid is taken out, an atmosphere communication port for providing communication between the container body and the air, and gas-liquid separating element for passing through only a gas, the gas-liquid separating element being disposed in the atmosphere communication port, the method being characterized by comprising the step of thermally bonding at least an outer periphery of the gas-liquid separating element on the atmosphere communication port using a laser. According to the present invention, the thermal adverse effects on the ventilation area of the gas-liquid separating area can be minimized to restrain the deterioration of the liquid repellency thereof.

The twenty-seventh aspect of the present invention is in a method for manufacturing a liquid tank comprising a negative-pressure introducing section for introducing negative pressure into the liquid tank, a liquid intake section for taking a liquid in the liquid tank on the basis of the negative pressure introduced by the negative-pressure introducing section, and a gas-liquid separating element for passing through only a gas, the gas-liquid separating element being disposed in the negative-pressure introducing section, the method being characterized by comprising the step of fusing at least an outer periphery of the gas-liquid separating element by ultrasonic bonding while holding at least part of a ventilation area of the gas-liquid separating element using vibration isolating means. According to the present invention, the ventilation area of the gas-liquid separating element is substantially prevented from being stretched owing to vibration.

The twenty-eighth aspect of the present invention is in a method for manufacturing a liquid tank comprising a container body for storing a liquid, an opening through which the liquid is taken out, an atmosphere communication port for providing communication between the container body and the air, and gas-liquid separating element for passing through only a gas, the gas-liquid separating element being disposed in the atmosphere communication port, the method being characterized by comprising the step of fusing at least an outer periphery of the gas-liquid separating element by ultrasonic bonding while holding at least part of a ventilation area of the gas-liquid separating element using vibration isolating means. According to the present invention, the ventilation area of the gas-liquid separating element is substantially prevented from being stretched owing to vibration.

In the method for manufacturing the liquid tank according to any one of the seventeenth to twenty-eighth aspects of the present invention, the gas-liquid separating element may be composed of PTFE. In this case, the gas-liquid separating element may undergo liquid repellency treatment. If the gas-liquid separating element comprises PTFE, which is chemically stable and fine resist heat, liquid repellency treatment specifically enables the liquid repellency of the gas-liquid separating element to be appropriately maintained for a long time.

A twenty-ninth aspect of the present invention is in a liquid tank characterized by depending on a manufacture method for an ink tank according to any one of the seventeenth to twenty-eighth aspects of the present invention. If the liquid structure is constructed in this manner, appropriate liquid repellency is maintained in the ventilation area of the gas-liquid separating element joined to the negative-pressure introducing section or the atmosphere communication port.

A thirtieth aspect of the present invention is in an ink jet apparatus characterized by comprising a negative-pressure generating mechanism for introducing a liquid by exerting negative pressure on a liquid tank according to any one of the eleventh and twenty-ninth aspects of the present invention. According to the present invention, when the liquid is introduced into the liquid tank, the liquid repellency of the ventilation area of the gas-liquid separating element is appropriately maintained.

The thirty-first aspect of the present invention is in an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, and a gas-liquid separating element for passing through only a gas, said gas-liquid separating element being disposed in a vicinity of a connecting portion which connects said negative-pressure generating mechanism and the negative-pressure introducing section, the ink jet apparatus characterized by comprising the gas-liquid separating element has a joined portion formed at least on an outer periphery of the gas-liquid separating element and joined to the vicinity of the connecting portion, and a ventilation area that contributes to ventilation. According to the present invention, the liquid repellency of the ventilation area can be appropriately maintained.

In the ink jet apparatus according to the thirty-first aspect of the present invention, the gas-liquid separating element may further have a non-joined portion between the joined portion and the ventilation area. In this case, the non-joined area may be a non-heated area. If the non-joined area is provided between the joined portion and the ventilation area of the gas-liquid separating element, it serves to reduce the adverse effects of the jointed portion on the ventilation area, thereby more appropriately maintaining the liquid repellency of the ventilation area. In particular, if the non-joined area is a non-heated area, even if the joined portion is a thermally bonded portion, the presence of the non-joined area, which is not heated, protects the ventilation area of the gas-liquid separating element from thermal adverse effects, thereby more appropriately maintaining the liquid repellency of the gas-liquid separating element.

The joined portion may be the thermally bonded portion. In this case, the gas-liquid separating element can be reliably joined to the communication portion.

The thirty-second aspect of the present invention is in an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, a gas-liquid separating element for passing through only a gas, the gas-liquid separating element being disposed in a vicinity of a connecting portion which connects the negative-pressure generating mechanism and the negative-pressure introducing section, and an adhesive layer for joining said gas-liquid separating element and the vicinity of the connecting portion, the adhesive layer being formed between the gas-liquid separating element and the vicinity of the connecting portion. According to the present invention, the gas-liquid separating element need not be heated at high temperature, and its liquid repellency can thus be more appropriately maintained.

In the ink jet apparatus according to the thirty-second aspect of the present invention, an adhesive constituting the adhesive layer may be a thermosetting adhesive that is hardened at a temperature at which the gas-liquid separating element is not thermally adversely affected. Alternatively, the adhesive may be a hot-melt adhesive that is melted at a temperature at which the gas-liquid separating element is not thermally adversely affected. If such a thermosetting adhesive or hot-melt adhesive is used, the gas-liquid separating element can be reliably fixed to the negative-pressure introducing section without degrading the liquid repellency of the gas-liquid separating element.

The thirty-third aspect of the present invention is in an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, a gas-liquid separating element for passing through only a gas, the gas-liquid separating element being disposed in a vicinity of a connecting portion which connects the negative-pressure generating mechanism and the negative-pressure introducing section, and a holding member for holding at least an outer periphery of the gas-liquid separating element between the holding member and the vicinity of the connecting portion, the holding member being attached to the vicinity of the connecting portion. According to the present invention, the gas-liquid separating element need not be heated at high temperature, and its liquid repellency can thus be more appropriately maintained.

In the ink jet apparatus according to any one of the thirtieth to thirty-third aspects of the present invention, the gas-liquid separating element may be composed of PTFE. In this case, the gas-liquid separating element may undergo liquid repellency treatment. If the gas-liquid separating element comprises PTFE, which is chemically stable and fine resist heat, liquid repellency treatment specifically enables the liquid repellency of the gas-liquid separating element to be appropriately maintained for a long time.

The liquid tank may store ink or a treatment liquid used to orient the print property of ink on a print medium. In this case, the liquid tank may be immediately used for an ink jet apparatus or an image forming apparatus.

The thirty-fourth aspect of the present invention is in a method for manufacturing an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, and a gas-liquid separating element for passing through only a gas, the gas-liquid separating element being disposed in a vicinity of a connecting portion which connects the negative-pressure generating mechanism and the negative-pressure introducing section, the method being characterized by comprising the step of heating the gas-liquid separating element from a surface thereof which is opposite a surface thereof which faces the exterior to thermally bond at least an outer periphery of the gas-liquid separating element on the vicinity of the connection portion. According to the present invention, the deterioration of the liquid repellency of the gas-liquid separating element can be minimized.

The thirty-fifth aspect of the present invention is in a method for manufacturing an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, and a gas-liquid separating element for passing through only a gas, the gas-liquid separating element being disposed in a vicinity of a connecting portion which connects the negative-pressure generating mechanism and the negative-pressure introducing section, the method being characterized by comprising the steps of thermally bonding at least an outer periphery of the gas-liquid separating element on the vicinity of the connecting portion using an annular thermal fusion head, and during the thermal fusion step, sucking air from an interior of the thermal fusion head. According to the present invention, the thermal adverse effects on a ventilation area of the gas-liquid separating element can be suppressed to further restrain the deterioration of the liquid repellency thereof.

The thirty-sixth aspect of the present invention is in a method for manufacturing an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, and a gas-liquid separating element for passing through only a gas, the gas-liquid separating element being disposed in a vicinity of a connecting portion which connects the negative-pressure generating mechanism and the negative-pressure introducing section, the method being characterized by comprising the steps of thermally bonding at least an outer periphery of the gas-liquid separating element on the vicinity of the connecting portion using an annular thermal fusion head, and during the thermal fusion step, sucking air from an interior of the thermal fusion head. According to the present invention, the thermal adverse effects on a ventilation area of the gas-liquid separating element can be suppressed to further restrain the deterioration of the liquid repellency thereof.

The thirty-seventh aspect of the present invention is in a method for manufacturing an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, and a gas-liquid separating element for passing through only a gas, the gas-liquid separating element being disposed in a vicinity of a connecting portion which connects the negative-pressure generating mechanism and the negative-pressure introducing section, the method being characterized by comprising the steps of pressing an annular thermal fusion head against the vicinity of the connecting portion via the gas-liquid separating element, and after pressing the thermal fusion head at least against an outer periphery of the gas-liquid separating element, heating only a tip portion of the thermal fusion head to thermally bond at least the outer periphery of the gas-liquid separating element on the connecting portion. According to the present invention, the thermal adverse effects on a ventilation area of the gas-liquid separating element can be suppressed to further restrain the deterioration of the liquid repellency thereof.

The thirty-eighth aspect of the present invention is in a method for manufacturing an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, and a gas-liquid separating element for passing through only a gas, the gas-liquid separating element being disposed in a vicinity of a connecting portion which connects the negative-pressure generating mechanism and the negative-pressure introducing section, the method being characterized by comprising the step of thermally bonding at least an outer periphery of the gas-liquid separating element on the vicinity of the connecting portion using a laser. According to the present invention, the thermal adverse effects on the ventilation area of the gas-liquid separating area can be minimized to restrain the deterioration of the liquid repellency thereof.

The thirty-ninth aspect of the present invention is in a method for manufacturing an ink jet apparatus comprising a negative-pressure generating mechanism for introducing a liquid into a liquid by exerting negative pressure on the liquid tank, the liquid tank having a negative-pressure introducing section for introducing negative pressure into the liquid tank and a liquid intake section for taking a liquid in the liquid tank on the basis of the negative pressure introduced by the negative-pressure introducing section, and a gas-liquid separating element for passing through only a gas, the gas-liquid separating element being disposed in a vicinity of a connecting portion which connects the negative-pressure generating mechanism and the negative-pressure introducing section, the method being characterized by comprising the step of fusing at least an outer periphery of the gas-liquid separating element by ultrasonic bonding while holding at least part of a ventilation area of the gas-liquid separating element using vibration isolating means. According to the present invention, the ventilation area of the gas-liquid separating element is substantially prevented from being stretched owing to vibration.

In the method for manufacturing the ink jet apparatus according to any one of the thirty-fourth to thirty-ninth aspects of the present invention, the gas-liquid separating element may be composed of PTFE. In this case, the gas-liquid separating element may undergo liquid repellency treatment. If the gas-liquid separating element comprises PTFE, which is chemically stable and fine resist heat, liquid repellency treatment specifically enables the liquid repellency of the gas-liquid separating element to be appropriately maintained for a long time.

A fortieth aspect of the present invention is in an ink jet apparatus characterized by being constructed using a manufacture method for an ink jet apparatus according to any one of the thirty-fourth to thirty-ninth aspects of the present invention. If the ink jet apparatus is constructed in this manner, appropriate liquid repellency is maintained in the ventilation area of the gas-liquid separating element joined to the vicinity of the connecting portion which connects the negative-pressure generating mechanism and the negative-pressure introducing section.

A forty-first aspect of the present invention is in a head cartridge characterized by comprising a liquid tank according to any one of the eleventh to sixteenth aspects and twenty-ninth aspect of the present invention, and a liquid ejecting head having an ejection opening that eject a liquid supplied by the liquid tank. According to the present invention, the liquid repellency of the ventilation area of the gas-liquid separating element fixed within the liquid tank is appropriately maintained.

A forty-second aspect of the present invention is in a head cartridge characterized by comprising a liquid ejecting head having an ejection opening that eject a liquid supplied by a liquid tank according to any one of the thirtieth to thirty-third aspects and fortieth aspect of the present invention. According to the present invention, the liquid repellency of the ventilation area of the gas-liquid separating element fixed within the liquid tank is appropriately maintained.

In the head cartridge according to the forty-first or the forty-second aspects of the present invention, the liquid ejecting head may further comprise an electrothermal transducer that generates thermal energy as ejection energy used to eject a liquid through the ejection opening.

A forty-third aspect of the present invention is in an image forming apparatus characterized by comprising a carrying portion which a liquid tank according to any one of the eleventh to sixteenth aspects and the twenty-ninth aspect of the present invention and liquid ejecting head having an ejection opening for ejecting a liquid supplied from the liquid tank are attachable, and means for moving the liquid ejecting head respect to the print medium. According to the present invention, the liquid repellency of the ventilation area of the gas-liquid separating element fixed within the liquid tank is appropriately maintained.

A forty-fourth aspect of the present invention is in an image forming apparatus characterized by comprising a carrying portion which a liquid tank of an ink jet apparatus according to any one of the thirtieth to thirty-third aspects and fortieth aspect of the present invention and liquid ejecting head having an ejection opening for ejecting a liquid supplied from the liquid tank are attachable, and means for relatively moving the liquid ejecting head to the print medium. According to the present invention, the liquid repellency of the ventilation area of the gas-liquid separating element fixed within the liquid tank is appropriately maintained.

A forty-fifth aspect of the present invention is in an image forming apparatus characterized by comprising a carrying portion which a head cartridge according to the forty-first or forty-second aspects of the present invention is attachable, and means for relatively moving the head cartridge to the print medium. According to the present invention, the liquid repellency of the ventilation area of the gas-liquid separating element fixed in the liquid tank is appropriately maintained.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments in which the present invention is applied to an ink jet printer will be described with reference to FIGS. 1 to 25. However, the present invention is not limited to these embodiments, but they may be combined together or applied to other techniques to be embraced in the concepts of the present invention set for the in the claims.

Figure 1:
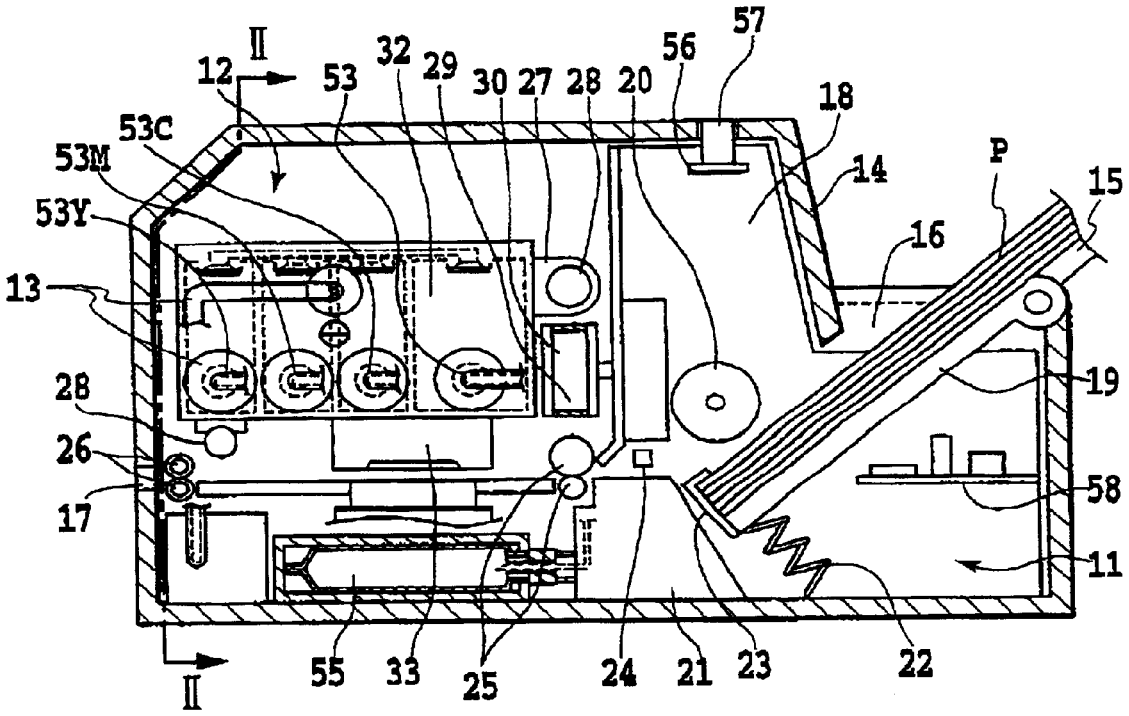
FIG. 1 is a sectional view of an embodiment in which an image forming apparatus according to the present invention is applied to a serial type ink jet printer.
Figure 2:
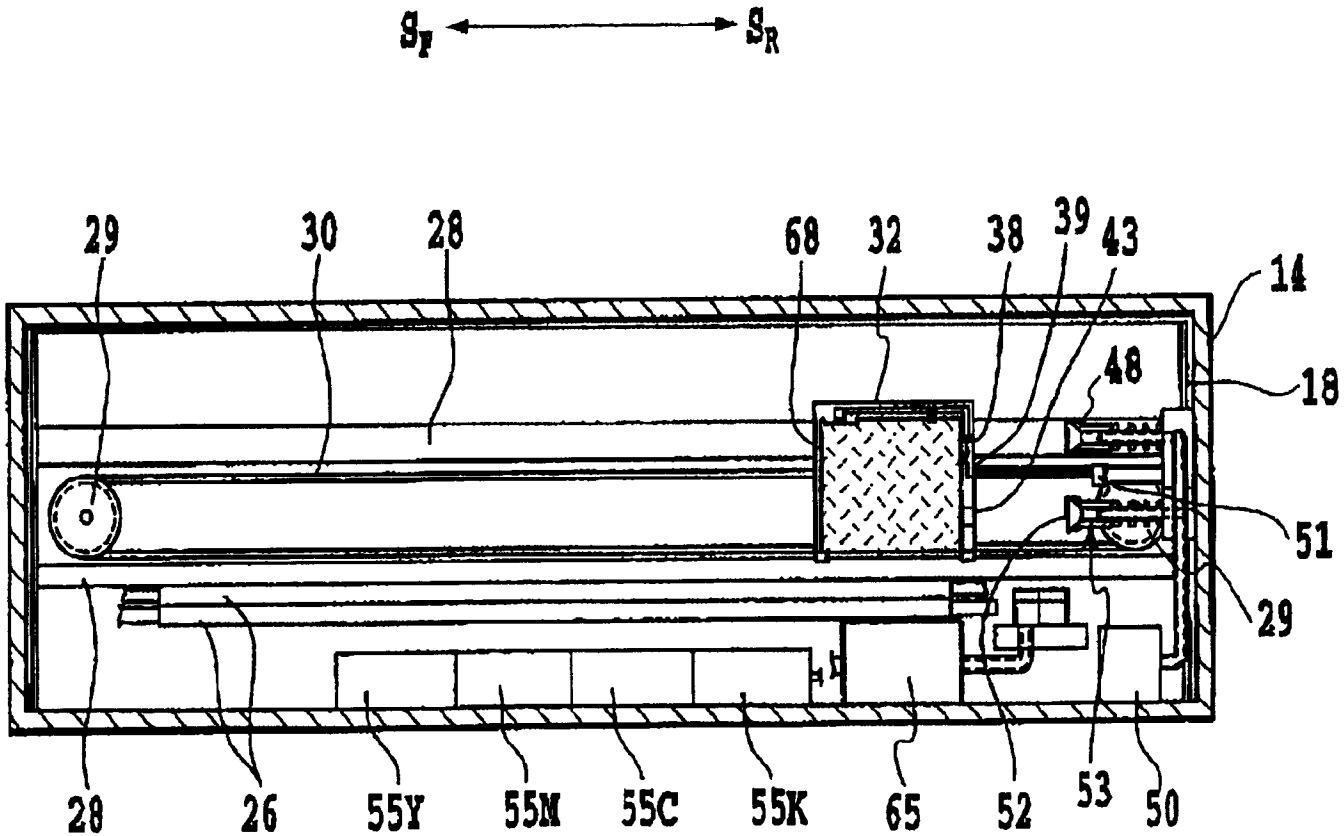
FIG. 2 is a sectional view taken along line II—II in FIG. 1.

FIGS. 1 and 2 are sectional views schematically representing the structure of an ink jet printer according to this embodiment. The ink jet printer of this embodiment is an application of a serial scan method of moving a liquid ejecting head in main-scanning directions $S_R$ and $S_F$. In FIG. 1, the printer main body is composed of a medium feeding section 11 that feeds a print medium P, a print section 12 that performs a print operation, an ink refilling section 13 that supplies ink as a liquid according to the present invention.

Reference numeral 14 denotes a cover provided outside the printer main body, and reference numeral 15 denotes an installation table on which a plurality of print medium P are placed. The print medium P are inserted into an insertion port 16 and discharged from a discharge port 17. A mounting table 19, a feed roller 20, and a guide member 21 are provided inside a side plate 18 installed in the cover 14. The mounting plate 19 constitutes a means on which the print medium P are mounted and is urged and biased toward the feed roller 20, located above, by a spring 22. The feed roller 20 constitutes a medium feeding means and abuts against the uppermost one of the plurality of print medium P on the mounting table 19. The guide member 21 guides one print medium P separated by a separating means 23.

Reference numeral 24 denotes a photosensor that detects the print medium passing through the downstream side of the guide member 21. Reference numeral 25 denotes a pair of transportation rollers that transport the fed print medium P at a fixed speed. Reference numeral 26 denotes a pair of transportation rollers that transport the print medium P after an image has been printed thereon. Reference numeral 27 denotes a carriage that is guided by a pair of guide members 28 so as to move in the main-scanning directions $S_R$ and $S_F$ (the cross direction of the print medium P). The carriage 27 is moved in the main-scanning directions $S_R$ and $S_F$ via a belt 30 extended between a pair of pulleys 29, by drive force transmitted by a carriage motor 31. Reference numeral 32 is a storage liquid tank replaceably mounted in the carriage 27, that is, a storage ink tank. The storage ink tank 32 has a plurality of ink storage sections 32Y, 32M, 32C, and 32K corresponding to, for example, yellow, magenta, cyan, and black. Reference numeral 33 denotes an ink jet head (hereinafter referred to as a "print head"). The print head 33 ejects a plurality of color inks supplied by the ink storage sections 32Y, 32M, 32C, and 32K, on the basis of image information.

In this embodiment, the storage ink tank 32 and the print head 33 are integrally coupled together to constitute a head cartridge. The storage ink tank 32 and the print head 33 may be individually constructed and removably coupled together. Alternatively, the storage ink tank 32 and the print head 33 may be individually installed on the carriage 27.

Figure 3:
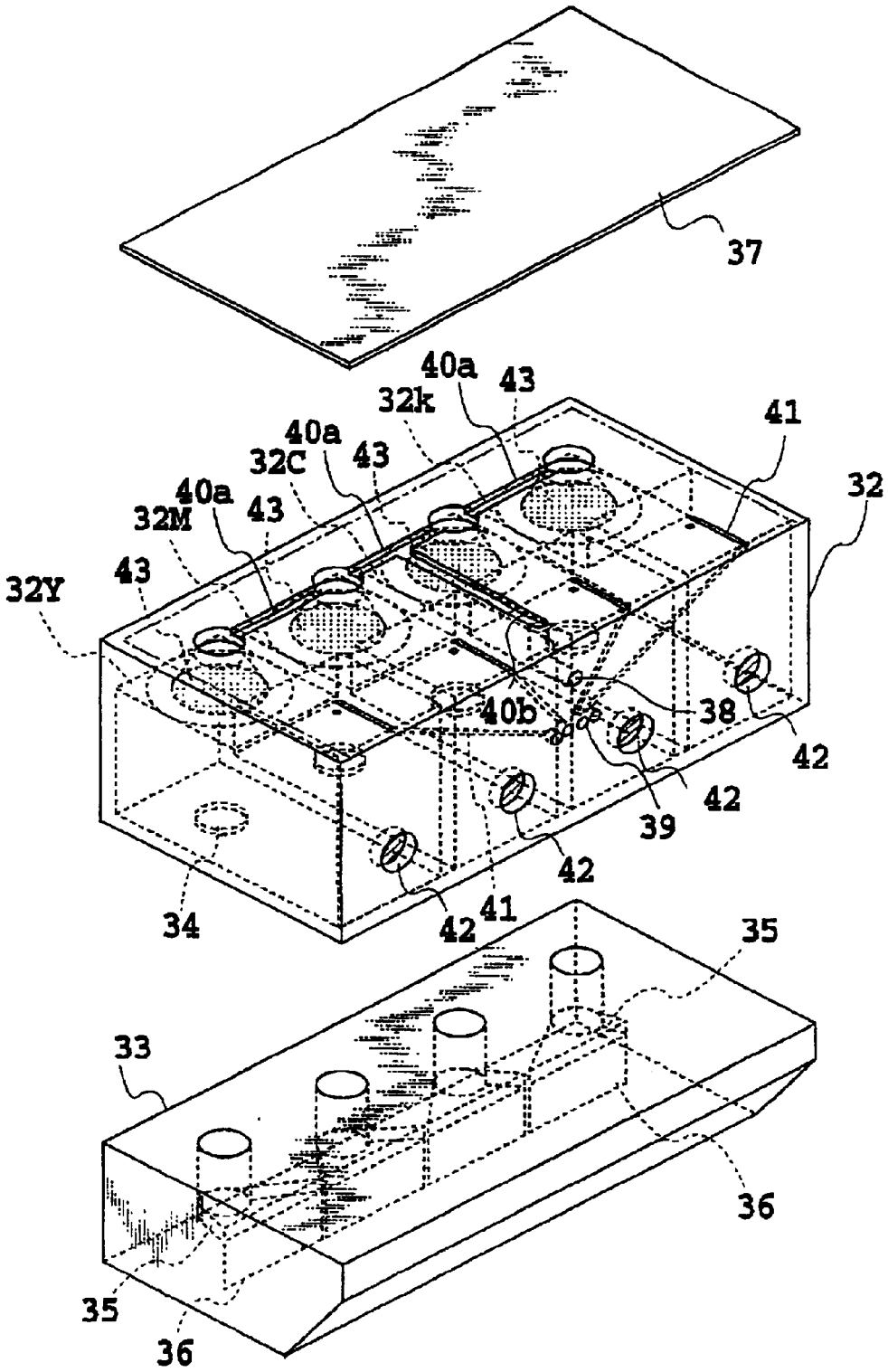
FIG. 3 is an exploded perspective view of a head cartridge according to the embodiment shown in FIG. 1.

FIG. 3 shows how the head cartridge according to this embodiment is disassembled. The print head 33 is composed of a plurality of independent head portions for the respective colors used (in this embodiment, four colors including yellow, magenta, cyan, and black). The head portions are provided with a common ink chamber 35 that is in communication with an ink supply port 34 in the corresponding storage ink tank 32, and a plurality of ejection ports 36 that ejects ink droplets of the respective colors. An ink passage portion that communicates between the common ink chamber 35 and each ejection port 36 is provided with an ejection energy generating section (not shown) that generates energy required to eject the ink through the ejection port 36.

In this embodiment, ventilation passages 40*a*, 40*b*, and 41 between the storage ink tanks 32 and both a common suction port 38 and atmosphere communication ports 39 are formed of grooves formed in the top surface of the main body of the storage ink tank 32 and a cover member 37 coupled to the top surface of the main body.

In this embodiment, the atmosphere communication ports 39 have a relatively small diameter. However, to prevent ink deposited on the periphery of an ink intake port 42 from shutting off the atmosphere communication ports 39, the diameter of the atmosphere communication ports 39 may be increased only in its open end without any change in the cross section of the ventilation passage 41.

Figure 4:
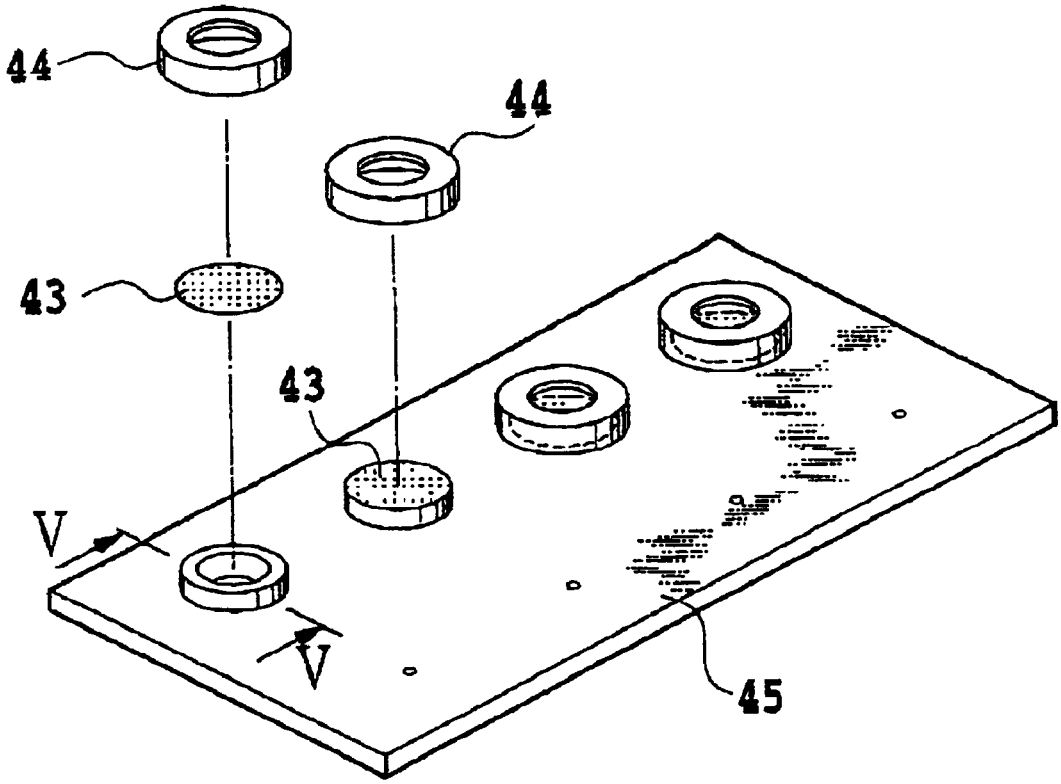
FIG. 4 is an exploded perspective view of a top surface plate of the head cartridge shown in FIG. 3, as viewed from a rear surface.
Figure 5:
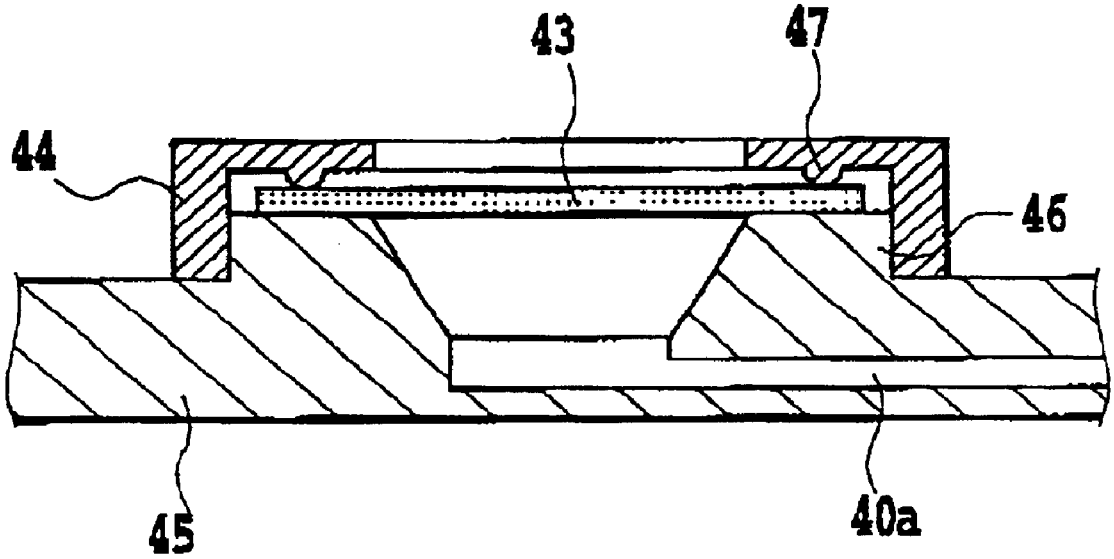
FIG. 5 is a sectional view taken along line V—V in FIG. 4.

FIG. 4 shows how a portion of the storage ink tank on 32 which gas-liquid separating elements 43 are mounted can be disassembled. FIG. 5 shows the sectional structure of a portion of the storage ink tank 32 on which the gas-liquid separating element 43 is mounted. That is, reference numeral 44 denotes a presser member made of a resin or metal. The presser member 44 is arranged so as to be located inside the storage ink tank 32. Reference numeral 45 denotes a top surface plate of the storage ink tank 32, which is integrated with the cover member 37 shown in FIG. 3. The gas-liquid separating element 43 is fixed by having its outer periphery sandwiched by the top surface plate 45 and the presser member 44. The inner diameter of the presser member 44 and the outer diameter of a recess 46 of the top surface plate 45 are set to have an interference fit relationship. Accordingly, in a press-in fixed state as shown in the figure, the pressure member 44 does out slip out from the recess 46 in spite of a variation in environment or vibration. The presser member 44 has an annular projection 47 that abuts against and slightly cuts into the outer periphery of the gas-liquid separating element 43. This allows the presser member 44 and the gas-liquid separating element 43 to tightly contact with each other to prevent the leakage of the ink. In this embodiment, no heat is used to fix the gas-liquid separating elements 43 to the top surface plate 45, thereby appropriately maintaining the liquid repellency of the gas-liquid separating elements 43 for a long time.

The gas-liquid separating elements 43 provided in the respective storage ink tanks function as gas-liquid separating elements according to the present invention which do not allow the ink to permeate therethrough, while allowing a gas such as air or vapors to pass therethrough.

The gas-liquid separating elements 43 are composed of thin films formed of, for example, PTFE (tetrafluoro ethylene resin) or a similar resin porous material. An air discharge path in the storage ink tank 32 in this embodiment leads from the common ventilation path 40*b* to the common suction port 30 via the respective gas-liquid separating elements 43 and the ventilation path 40*a* as shown in FIG. 3. The air in the storage ink tank 32 is sucked from a cap member 48 via a conduit 49 by a refilling suction pump 50, the cap member 48 coming into tight contact with a surface in which the common suction portion 38 is opened. That is, the above described ventilation paths 40*a* and 40*b*, the common suction port 38, and others correspond to a negative-pressure introducing section according to the present invention.

The material of the gas-liquid separating elements 43 is most preferably a fluorine resin such as PTFE, polychloro trifluoroethylene, a tetrafluoroethylene-hexafluoropropylene copolymer, a tetrafluoroethylene-perfluoroalkylvinylether copolymer, or a tetrafluoroethylene-ethylene copolymer because these materials appropriately resist chemicals. For example, a film obtained by making sheet of PTFE porous using a uniaxial or biaxial orientation process is particularly preferable because of its gas permeability. If the gas-liquid separating elements 43 comprise porous films of PTFE, a permeable support member may be laminated on this film in order to maintain strength. This support member may be a non-woven cloth, a woven cloth, or a net.

The gas-liquid separating elements 43 may be subjected to liquid repellency treatment depending on the nature of the ink. A liquid repellency process agent may comprise various fluorine-containing polymers having a perfluoroalkyl group. A polymer having a fluorine-containing chain forms a film of low surface free energy on surfaces of fibers to produce liquid repelling effects. The liquid repellency process is achieved by impregnating the gas-liquid separating elements 43 with a liquid repellency process agent or coating the gas-liquid separating elements 43 with the agent using a spray. The amount of liquid repellency process agent coated is preferably adjusted so as to obtain a sufficient liquid repellency, while preventing the ventilation of the gas-liquid separating elements 43 from being hindered.

Figure 6:
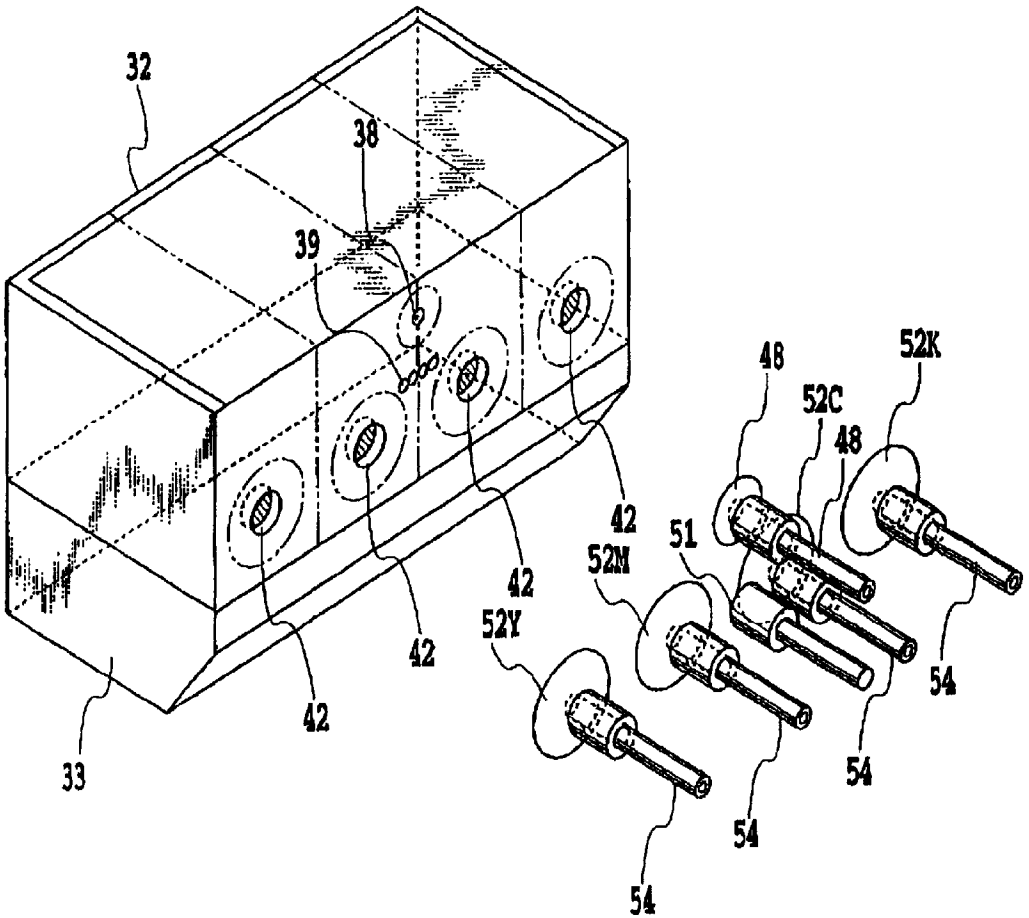
FIG. 6 is an exploded perspective view of a storage ink tank, shown in FIG. 3.

As described, the air discharge path between the ink storage sections 32Y, 32M, 32C, and 32K of the storage ink tank 32 and both the common suction port 38 and the atmosphere communication ports 39 is formed of grooves in the top surface of the main body of the storage ink tank and the cover member 37 coupled to the top surface of the main body (see FIGS. 3 and 6). The atmosphere communication ports 39 are sealed by a closing means 51 when the ink is supplied to the ink tank. In this embodiment, the atmosphere communication ports 39 for the four colors are integrated together and can be closed by one closing means 51 the tip of which is composed of an elastic member such as rubber. In this embodiment, to avoid the mixture of the colors in the ventilation passage 41 if the pressure in the storage ink tank 32 varies to cause the ink to flow out, the four atmosphere communication ports 39 including the ventilation passage 41 are independently formed.

Figure 7:
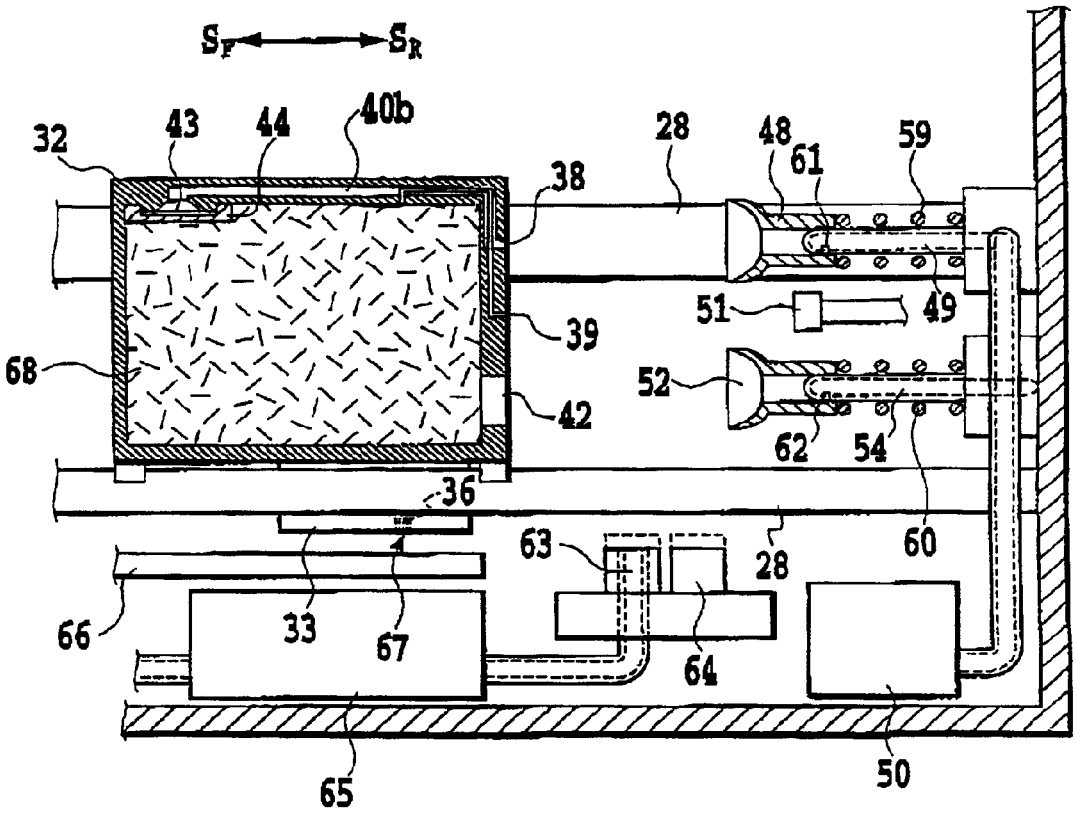
FIG. 7 is an enlarged sectional view of an ink refilling system, shown in FIG. 2.
Figure 8:
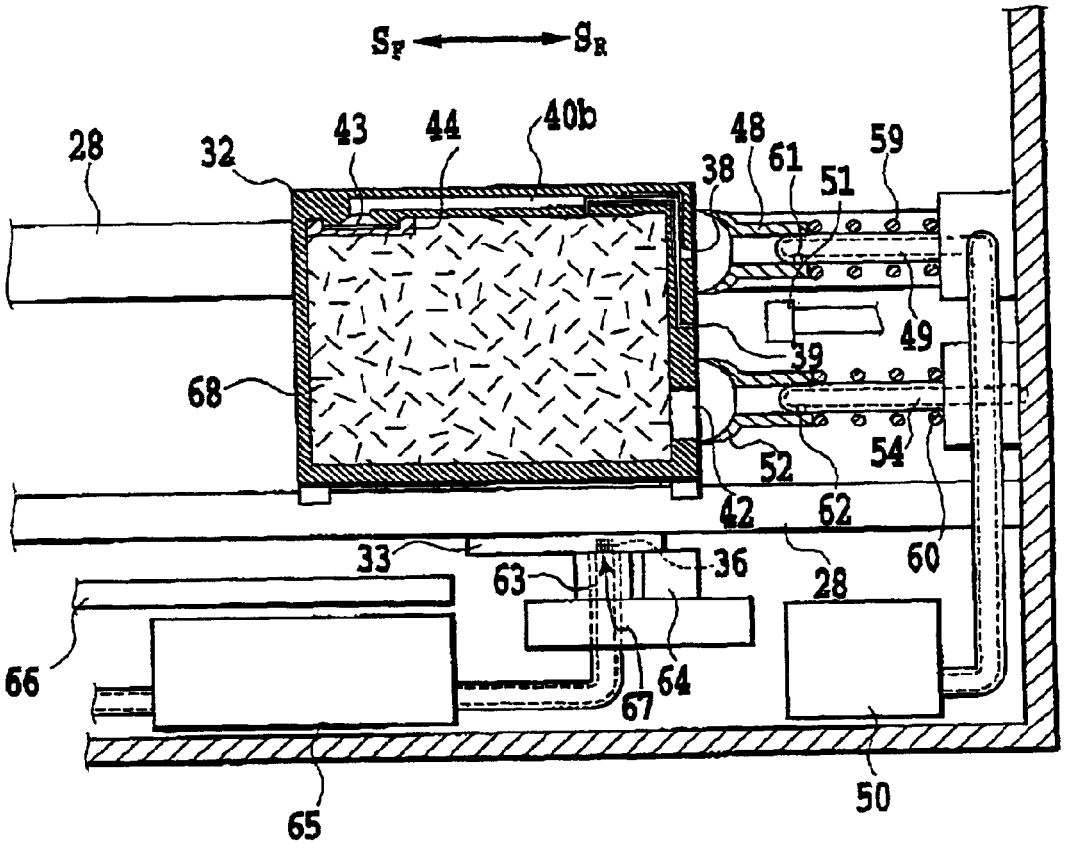
FIG. 8 is a process drawing representing, in connection with FIG. 9, the procedure of refilling the ink tank with ink using an ink refilling system, shown in FIG. 7, and showing that a power supply to the printer is turned off, or a standby state.
Figure 9:
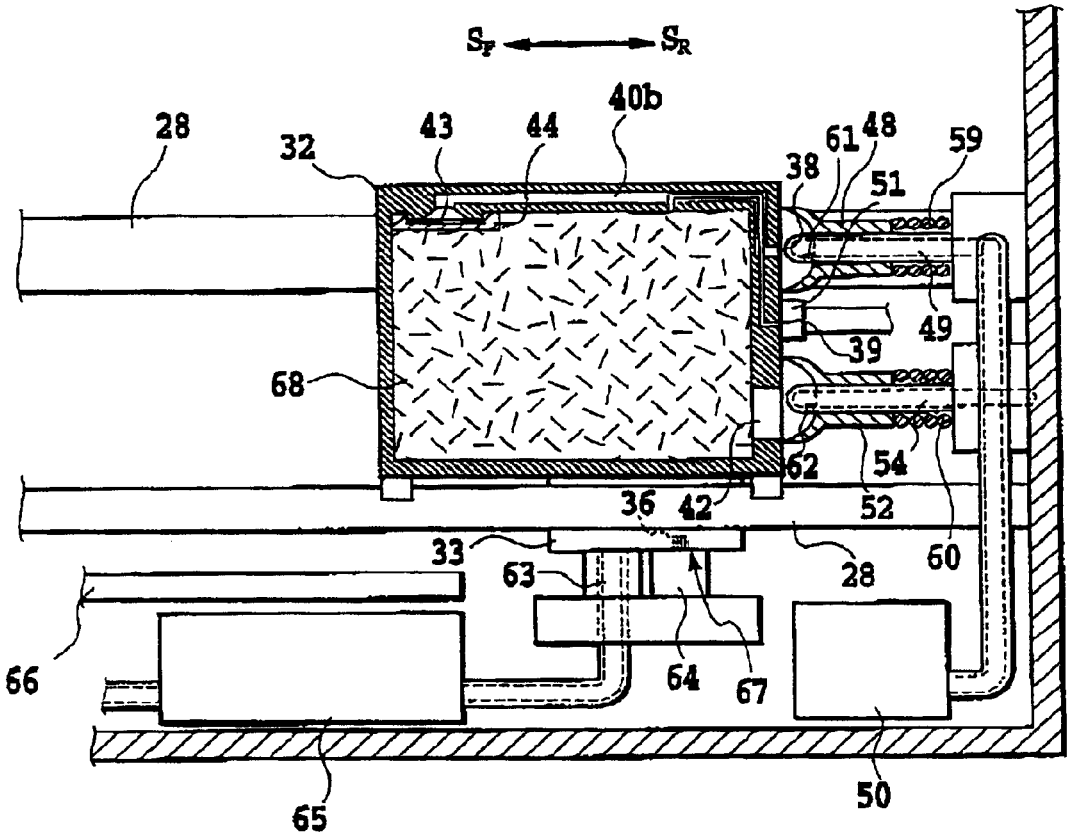
FIG. 9 is a process drawing representing, in connection with FIG. 8, the procedure of refilling the ink tank with ink using the ink refilling system shown in FIG. 7 and showing that the ink tank is being refilled with ink.

In FIGS. 7 to 9, reference numerals 52Y, 52M, 52C, and 52K (hereafter collectively represented as 52) denote supply cap members that can be connected to the corresponding ink intake ports 42 of the storage ink tank 32. The supply cap members 52 are connected to refilling ink tanks 55Y. 55M, 55C, and 55K hereinafter collectively represented as 55) via pipes 54 of ink refilling means 53Y, 53M, 53C, and 53K (hereinafter collectively represented as 53). Thus, the storage ink tank 32 can be refilled with ink from the refilling ink tank 55.

The refilling ink tank 55 in this embodiment is divided depending on the colors of the stored inks, that is, into the refilling ink tank 55Y for yellow ink, the refilling ink tank 55M for magenta ink, the refilling ink tank 55C for cyan ink, and the refilling ink tank 55C for black ink, as shown in FIG. 2. The refilling ink tanks 55Y, 55M, 55C, and 55K hereinafter collectively represented as 55) are connected to the corresponding ink refilling means 53Y, 53M, 53C, and 53K via the corresponding pipes 54. The storage ink tank 32 in FIG. 2 is in a position in which a print operation is being performed on the print medium P (not shown). The storage ink tank 32 assumes the print operation state shown in FIG. 7, a standby and power-off state, shown in FIG. 8, or an ink refilling state, shown in FIG. 9, depending on the positional relationship between the supply cap member 52 and the closing means 51 and the cap member 48. Each of these positions will be described later in detail.

In FIG. 1, reference numeral 56 denotes an electric wiring board arranged inside the cover 41. The electric wiring board 56 has a plurality of operation buttons 57 provided thereon and penetrating the cover 14 and protruding from a surface thereof. Reference numeral 58 denotes a control means, and the controlling electric wiring board arranged inside the cover 14 has a microcomputer and a memory mounted thereon. The control means 58 controls the operation of the ink jet printer while communicating with a host computer.

In FIG. 8, the cap member 48 and the supply cap member 52 are slidably fitted on the outer periphery of the hollow conduit 49 and each pipe 54, respectively, provided in the printer main body. A spring 59, 60 is interposed between the cap member 48, 52 and the conduit 49 or pipe 54, respectively, to urge and bias the cap member 48, 52, respectively, in the lateral direction in the figure. The pipe 54 and the conduit 49 have communication holes 61 and 62, respectively, formed therein and opened and closed by the cap member 48 and the supply cap members 52. The tips of the pipe 54 and conduit 49 are shut off. The proximal ends of the pipe 54 and conduit 49 are connected to the refilling ink tank 55 shown in FIGS. 1 and 2. Reference numerals 63 and 64 denote cap members provided in the printer main body so as to be movable in the vertical direction. One of the cap members, the recovery cap member 63 is connected to a waste liquid container (not shows) via a recovery suction pump 65. Reference numeral 66 denotes a platen used to guide the print medium to a print position where an image is printed by the print head 33.

FIG. 8 shows that the print head 33 has moved to its home position. In this state, the cap members 63 and 64 rise and the recovery cap member 64 shuts off an ejection opening surface 67 of the print head 33. In this case, the supply cap member 52 closes the ink intake port 42 while keeping the communication hole 62 in the pipe 54 closed. In this state, the closing means 51 does not close the atmosphere communication port 39. Accordingly, in this state, air can be introduced into or discharged from the storage ink tank 32 in response to a variation in the pressure in the storage ink tank 32 caused by a variation in the ambient temperature. The cap member 48 closes the common suction port 38 while keeping the communication port 61 closed. The print head 33 in its home position can be kept ejecting ink appropriately, using a head ejection recovery process (hereinafter simply referred to as a "recovery process") of discharging ink that does not contribute to image printing. This recovery process comprises introducing negative pressure generated by the recovery suction pump 65, into the recovery cap member 64 and forcibly sucking and discharging ink through the ejection port 36 in the print head 33, or ejecting ink to the interior of the recovery cap member 63 through the ejection port 36, or the like.

FIG. 9 shows that ink from the refilling ink tank 55 is supplied to the storage ink tank 32. To supply ink, the print head 33 moves in the direction shown by the arrow $S_R$ from its home position in FIG. 8 to its ink refilling position. If the print head 33 moves to its ink refilling position in this manner, the cap members 63 and 64 rise, and the refilling cap member 64 covers the ejection opening surface 67 of the print head 33. The refilling cap member 64 closes the ejection opening surface 67 of the print head 33. In this case, the supply cap member 52 opens the communication port 62 by moving relative to the pipe 54, while keeping the ink intake port 42 closed. The communication port 62 is opened into the storage ink tank 32 to form an ink supply passage between the a storage ink tank 32 and the refilling ink tank 55. The closing means 51 keeps the atmosphere communication port 39 closed.

The cap member 48 opens the communication hole 61 by moving relative to the conduit 49. The communication hole 61 forms a suction path between the common suction port 38 and the refilling suction pump 50. The gas-liquid separating element 43 is incorporated in this suction path.

To supply ink, the refilling suction pump 50 sucks air from the storage ink tank 32 via the gas-liquid separating elements 43 and discharges it into the waste liquid container (not shown). This sets negative pressure in the storage ink tank 32. This negative pressure causes the ink in the refilling ink tank 55 to be sucked into the storage ink tank 32. The ink flowing into the storage ink tank 32 permeates through an ink retaining member 68. As the ink permeates therethrough, its level rises. The speed at which the level of the ink rises depends on the suction force of the refilling suction pump 50. Thus, the suction force of the refilling pump 50 is properly set so as to obtain the desirable speed at which the level of the ink rises. Once the level of the ink reaches the gas-liquid separating element 43, the ink refilling operation is automatically stopped because the gas-liquid separating element 43 does not allow the ink, that is, liquid molecules to be permeate therethrough.

After the ink suction operation has been completed, the print head 33 is moved to its home position or print operation position to recover the printer to the state shown in FIG. 7 or 8.

In the above described embodiment, the gas-liquid separating elements 43 are mounted in the storage ink tank 32. However, the construction of the present invention can be employed even if the gas-liquid separating elements are provided in the printer main body at a position at which they are opposite the common suction port 38 of the storage ink tank 32 in the ink refilling state in FIG. 9. Such an embodiment of the present invention will be described below with reference to FIGS. 10 to 13. However, those elements having the same functions as those in the above embodiment are denoted by the same reference numerals, and duplicate description is omitted.

Figure 10:
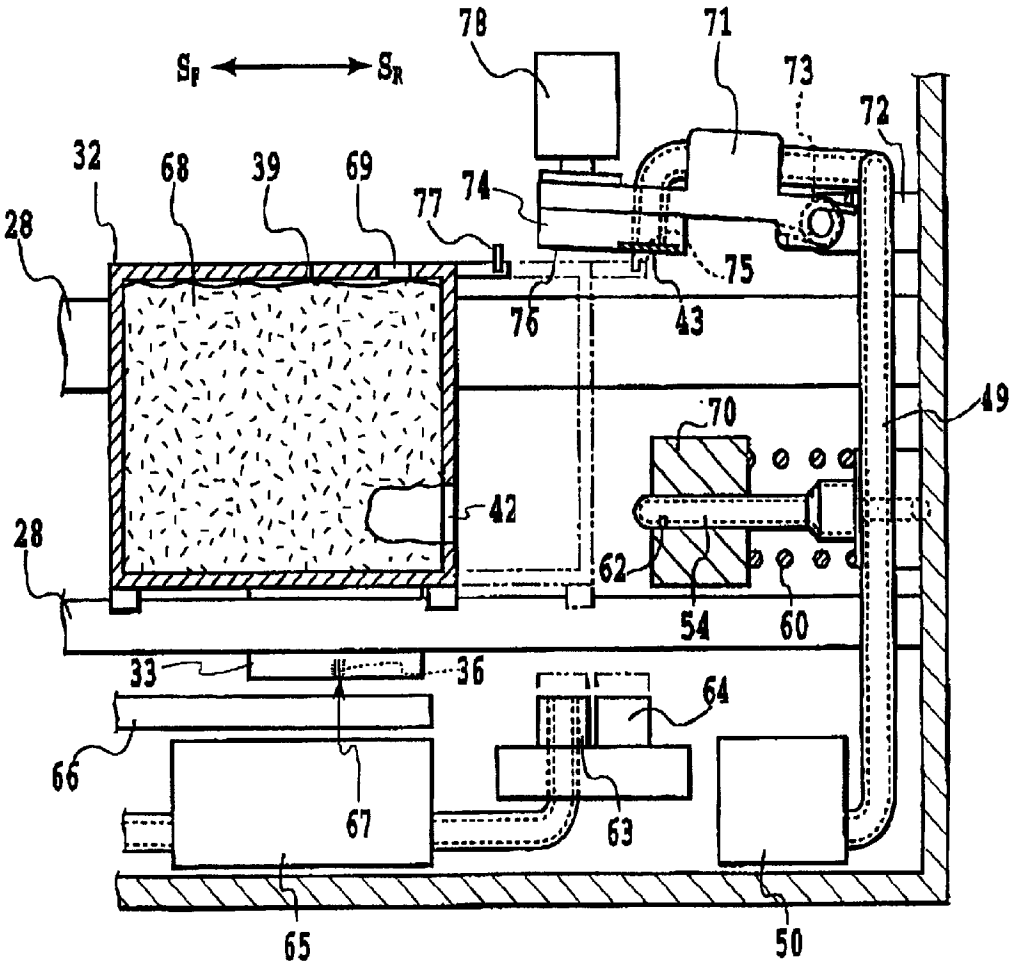
FIG. 10 is a sectional view representing the structure of a storage ink tank and an ink refilling system therefor according to another embodiment of the present invention.

In FIG. 10, reference numeral 32 denotes a storage ink tank that can store ink, reference numeral 33 denotes a print head that can eject the ink in the storage ink tank 32 through ejection openings (not shown). These are scanned in the main-scanning directions $S_R$ and $S_F$ along the pair of guide members 28. The storage ink tank 32 and the print head 33 can be removably mounted in a carriage (not shown) guided along the guide members 28. The storage ink tank 32 is provided with the ink intake ports 42, suction ports 69, the atmosphere communication ports 39, and ink supply ports (not shown) that are in communication with the print head 33. The storage ink tank 32 has the ink retaining members 68 stored therein to suck and retain ink.

Figure 11:
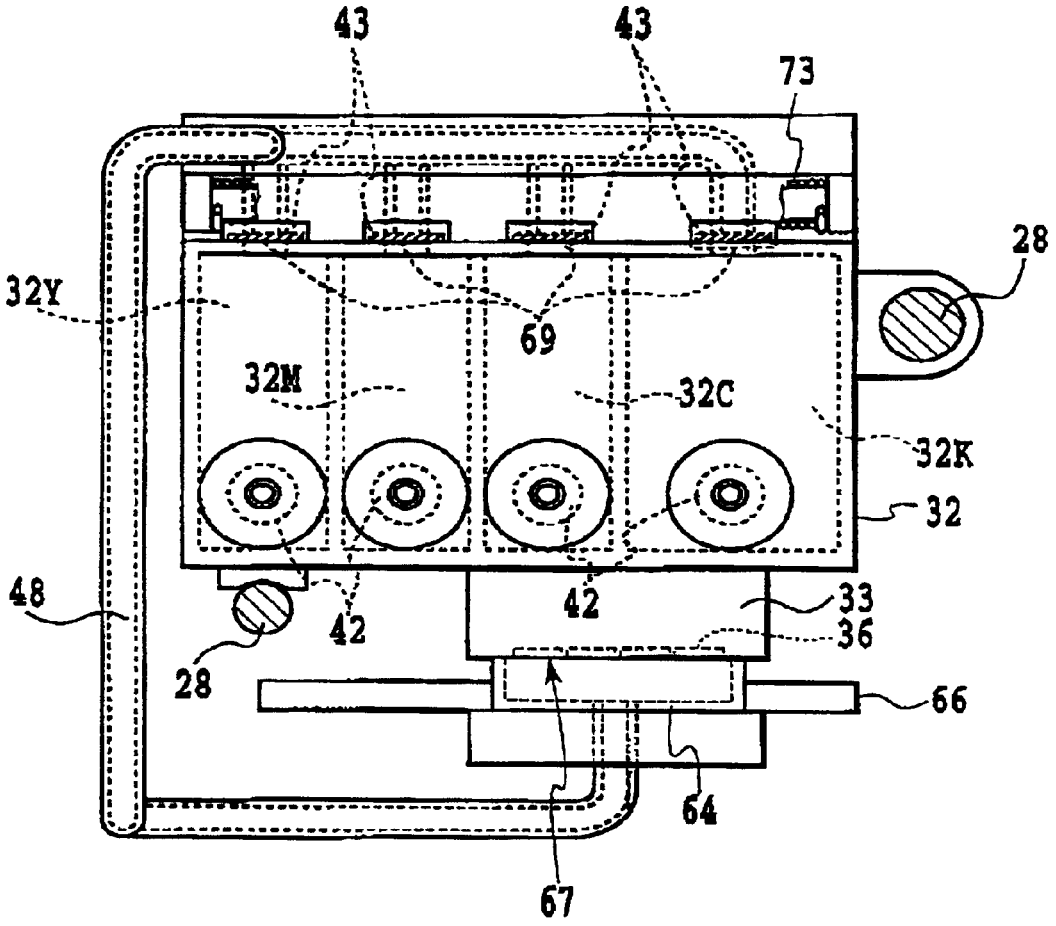
FIG. 11 is a right side view of the ink refilling system shown in FIG. 10.

In this embodiment, the storage ink tank 32 is provided with the ink storage sections 32Y, 32M, 32C, and 32K that store yellow, magenta, cyan, and black inks and the suction ports 69 corresponding to the respective ink storage sections 32Y, 32M, 32C, and 32K, as shown in FIG. 11. Taking the usage of the black ink into consideration, the ink storage section 32K for this color has a larger volume than the ink storage sections 32Y, 32M, and 32C. The ejection ports (not shown) in the print head 33 correspond to the respective ink colors.

The storage ink tank 32 and the print head 33 may be integrally coupled together to constitute an ink jet cartridge. Alternatively, separate ink tanks 32 and separate print heads 33 may be provided for the respective ink colors.

In FIG. 10, reference numeral 54 denotes a hollow pipe provided in the printer main body. The pipe 54 has a seal member 70 slidably fitted on the outer periphery thereof and urged and biased leftward by a spring 60. The pipe 54 has the communication hole 62 formed therein and which is opened and closed by the seal member 70. The tip of the pipe 54 is closed. The proximal end of the pipe 54 is connected to the refilling ink tank (not shown).

An arm member 71 is journaled to a support member 72 in the printer main body so as to rotationally movable in the vertical direction. The tip of the arm member 71 is urged and biased downward in the figure by a spring 73 incorporated between the arm member 71 and the support member 72. A seal block 74 attached to the tip of the arm member 71 is provided with openings 75 that can communicate with the suction ports 69 and seal portions 76 that can shut off the suction ports 69 and the atmosphere communication ports 39. The openings 75 are connected to the refilling suction pump 50 via the conduit 49. In this embodiment, the openings 75, each of which is formed in the corresponding one of the ink storage sections 32Y, 32M, 32C, and 32K, are merged into the conduit 49 and connected to the common as shown in FIG. 11. The openings 75 each have the gas-liquid separating element 43 attached thereto and which allows only a gas to permeate therethrough, while hindering a liquid such as ink from passing therethrough. The gas-liquid separating element 43 is composed of the same material as that described in the above embodiment. The surface of the gas-liquid separating element 43 is also subjected to similar liquid repellency treatment. The storage ink tank 32 is provided with a wiping blade 77 that can wipe off the gas-liquid separating element 43 and the bottom surface of the seal block 74. Reference numeral 78 denotes a stopper that restricts the upward movement position of the arm member 71.

A print medium is transported by a transportation mechanism (not shown) in the main-scanning directions (directions shown by the arrows $S_R$ and $S_F$) and sub-scanning directions crossing the main-scanning directions. Images are sequentially formed on the print medium by alternately repeating a main scanning operation of the print head 33 simultaneous with the ejection of ink and a transportation operation of the print medium in the sub-scanning directions.

Figure 12:
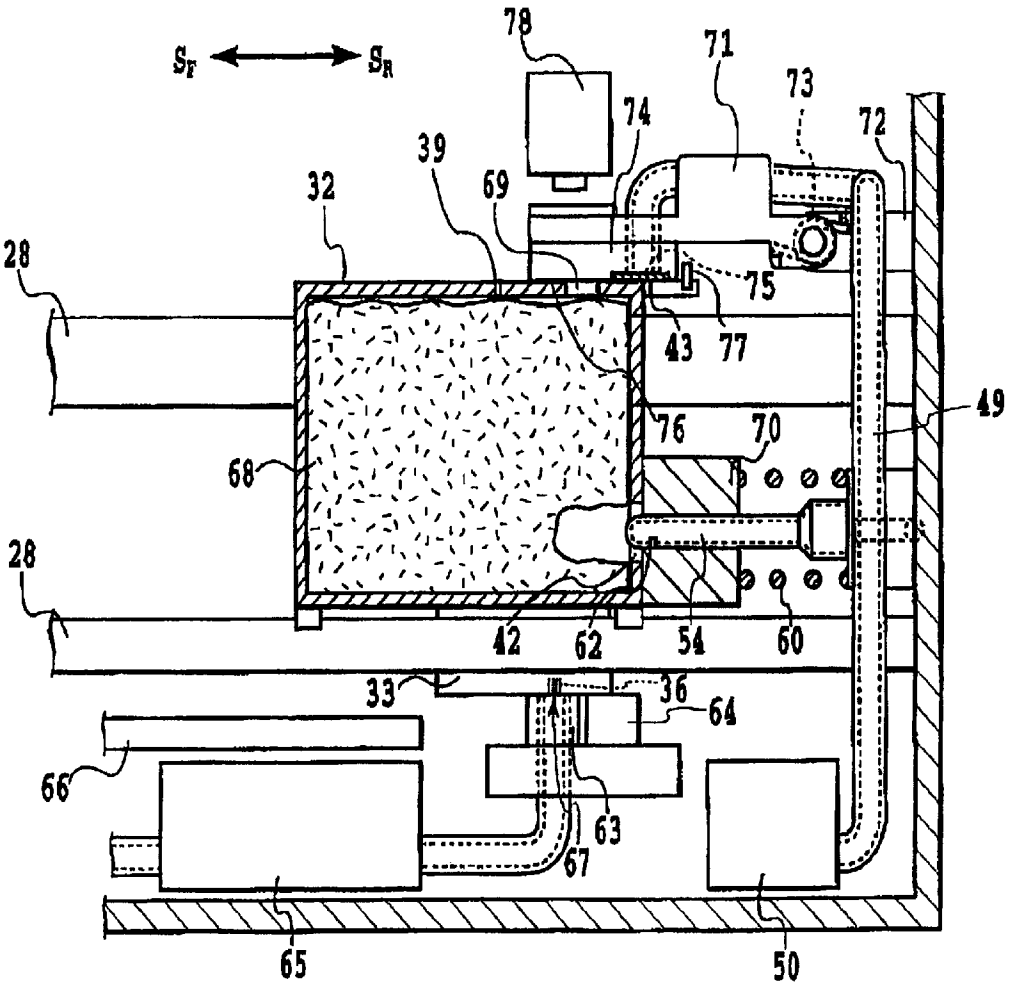
FIG. 12 is a process drawing representing, in connection with FIG. 13, the procedure of refilling the ink tank with ink using the ink refilling system shown in FIG. 10 and showing that the power supply to the printer is turned off, or the standby state.

During a print operation, the print head 33 ejects ink to print images on the print medium by executing scan movement in the directions of the arrows $S_R$ and $S_F$ at a position left to the home position in FIG. 12.

If the print head 33 moves to its home position, the cap members 63 and 64 rise, and the recovery cap member 63 covers the ejection opening surface 67 of the print head 33, as shown in FIG. 12. At this time, the seal member 70 closes the ink intake port 42, while keeping the communication port 62 in the pipe 54 closed. At the same time, the seal block 74 closes the suction port 69. By closing the ink intake port 42 and the suction port 69, the ink in the storage ink tank 32 is prevented from becoming more viscous. The gas-liquid separating element 43 is located in the right of FIG. 2 and away from the suction port 69. This prevents the gas-liquid separating element 43 from contacting with the ink in the storage ink tank 32. By avoiding the longtime contact between the gas-liquid separating element 43 and ink, the performance of the gas-liquid separating element 43 is restrained from being degraded. The print head 33 in its home position can be kept ejecting ink appropriately, using a head ejection recovery process of discharging ink that does not contribute to image printing. This recovery process comprises introducing negative pressure generated by the recovery suction pump 65, into the recovery cap member 63 and forcibly sucking and discharging ink through an ejection port (not shown) in the print head 33, or ejecting ink to the interior of the recovery cap member 63 through the ejection port 36, or the like.

Figure 13:
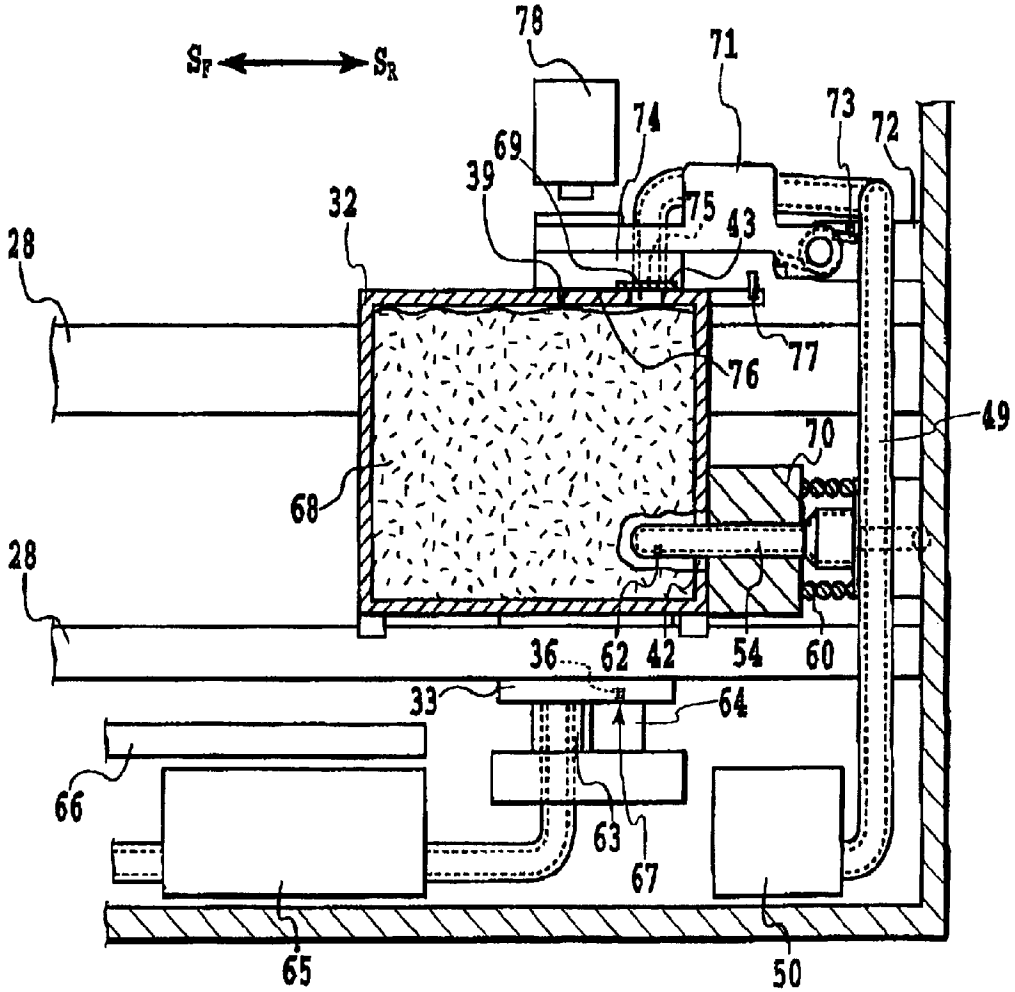
FIG. 13 is a process drawing representing, in connection with FIG. 12, the procedure of refilling the ink tank with ink using the ink refilling system shown in FIG. 10 and showing that the ink tank is being refilled with ink.

To supply ink, the print head 33 moves in the direction shown by the arrow $S_R$ from its home position to its ink refilling position, as shown in FIG. 13. If the print head 33 moves to its ink refilling position, the cap members 63 and 64 rise, and the refilling cap member 64 covers the ejection opening surface 67 of the print head 33. In this case, the seal member 70 opens the communication port 62 by moving relative to the pipe 54, while keeping the ink intake port 42 closed. The communication port 62 is opened into the storage ink tank 32 to define an ink supply path between the storage ink tank 32 and a refilling ink tank (not shown). Further, the seal block 74 closes the atmosphere communication port 39 and connects the opening 75 to the suction port 69 to define an air suction path between the suction port 69 and the refilling suction pump 50. The gas-liquid separating element 43 is incorporated in this suction path.

To supply ink, the air in the storage ink tank 32 is sucked through the gas-liquid separating element 43 and discharged to a liquid waste container (not shown). This sets the interior of the storage ink tank at a negative pressure, which causes the ink in the refilling ink tank 32 to be sucked into the storage ink tank 32. The ink flowing into the storage ink tank 32 permeates through the ink retaining member 68. As the ink permeates therethrough, its level rises. The speed at which the level of the ink rises depends on the suction force of the refilling suction pump 50. Thus, the suction force of the refilling pump 50 is properly set so as to obtain the desirable speed at which the level of the ink rises. Once the level of the ink reaches the gas-liquid separating element 43, the ink refilling operation is automatically stopped because the gas-liquid separating element 43 does not allow a liquid such as the ink to permeate therethrough. In this case, the ink simultaneously starts to be supplied to the ink storage sections 32Y, 32M, 32C, and 32K, but the ink supply to the respective ink storage sections is automatically sequentially stopped by the gas-liquid separating element 43 starting with the one that has been filled with the ink first.

After this ink refilling operation has been completed, the print head 33 is moved to its home position or print operation position to recover the printer to the state shown in FIG. 10 or 12.

By coming into contact with the bottom surface of the seal block 74 as the storage ink tank 32 moves, the wiping blade 77 wipes off the gas-liquid separating element 43 and the bottom surface of the seal block 74, while rotationally moving the arm member 71 in the vertical direction as shown by the alternate long and two short dashes line in FIG. 10. This wiping operation removes foreign matter such as ink with increased viscosity which has been deposited on the gas-liquid separating element 43 or the seal portion 76.

The present invention is not limited to the above described embodiment, but is applicable to, for example, an ink tank comprising a container body for storing ink supplied to the ink jet head, openings through which the ink is taken out, and atmosphere communication ports that allow the container body to communicate with the air and to which the corresponding gas-liquid separating elements are attached.

Now, an explanation will be given of another embodiment of the present invention in which the above described storage ink tank and refilling ink tank are connected together via a flexible pipe. However, those elements having the same functions as those in the above embodiment are denoted by the same reference numerals, and duplicate description is omitted.

Figure 14:
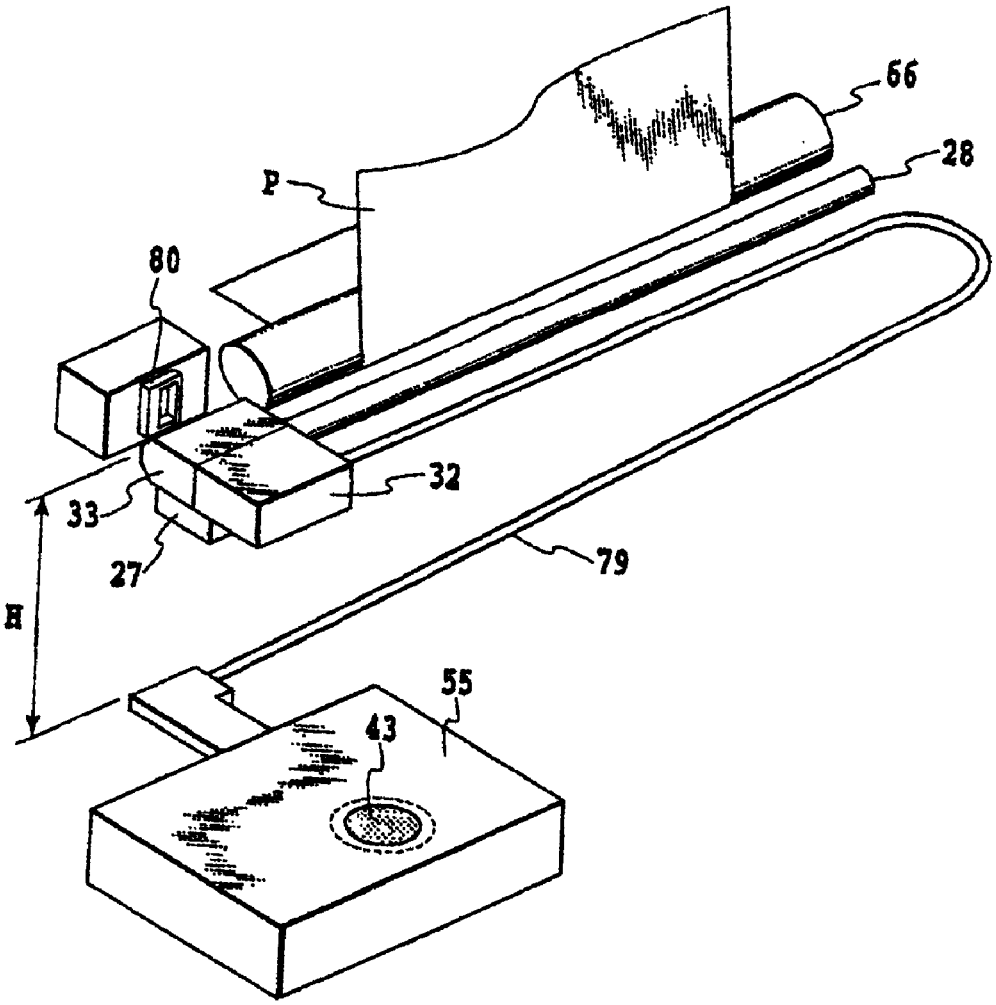
FIG. 14 is a perspective view schematically representing the construction of another embodiment in which an image forming apparatus according to the present invention is applied to a serial type ink jet printer.

As shown in FIG. 14, the print head 33 and the storage ink tank 32 are mounted on the carriage 27. A connection pipe 79 can be used to supply ink from the refilling ink tank 55 to the storage ink tank 32. To generate negative pressure in the storage ink tank 55, the refilling ink tank 55 is arranged several centimeters lower than the print head 33 in the vertical direction. This forms a water head difference H. Reference numeral 80 denotes a cap member that prevents the ejection opening surface of the print head 33 from being dried when the power supply is turned off or during the standby state. The refilling ink tank 55 has the gas-liquid separating element 43 fixed thereto. As the ink in the refilling ink tank 55 decreases, air is introduced into the refilling ink tank 55 via the gas-liquid separating element 43 fixed thereto to prevent the ink from leaking to the exterior.

The gas-liquid separating element of the present invention is applicable to an on-carriage method of replacing the storage ink tank 32 on the carriage 27 with a new one without providing the above described refilling ink tank 55. In this case, the gas-liquid separating element can be fixed to an arbitrary position of the storage ink tank 32.

In the above described embodiment, the gas-liquid separating element can be thermally bonded to the refilling ink tank. During fixation, considerations are required to minimize the thermal adverse effects on a central portion of the gas-liquid separating element 43, which corresponds to a ventilation area. Next, examples of methods of fixing the gas-liquid separating element 43 to the ink tank according to the present invention will be sequentially described. Those elements having the same functions as those in the above embodiment are denoted by the same reference numerals, and duplicate description is omitted.

Figure 15:
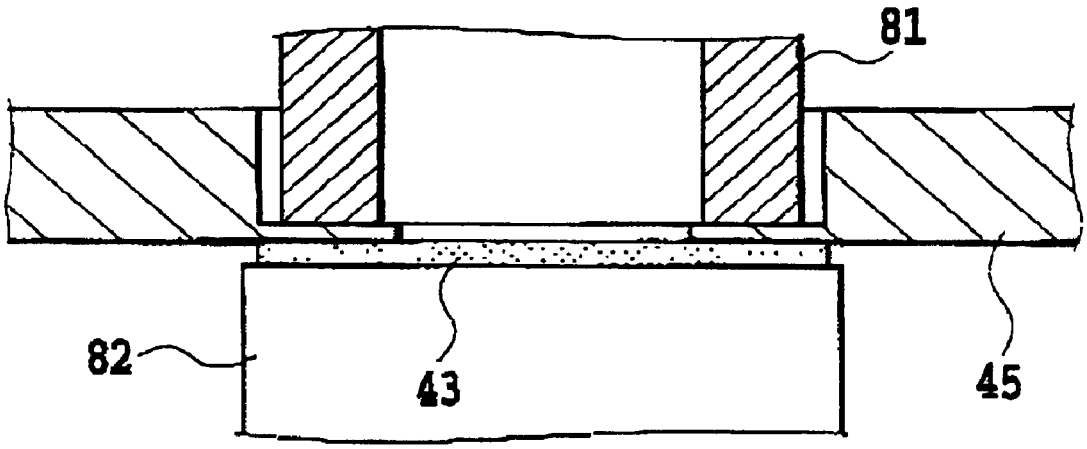
FIG. 15 is an operation conceptual drawing representing an embodiment of a manufacture method for a liquid tank according to the present invention.

In the embodiment shown in FIG. 15, reference numeral 81 denotes a thermal fusion head for thermal fusion, and reference numeral 45 denotes a top surface plate of the storage ink tank 32. The top surface plate 45 is composed of a resin molding member such as Noryl (trade-name by G. E. Corp.) or polypropylene. Reference numeral 82 denotes a support table that receives pressure from the thermal fusion head 81 during fusion. The support table 82 preferably comprises metal that appropriately transfers and radiates heat. The gas-liquid separating element 43 is placed on the support table 82, the top surface plate 45 is set thereon, and the heated thermal fusion head 81 is used to press the top surface plate 45. Then, the top surface plate 45 is thermally bonded on the gas-liquid separating element 43. At this time, a surface of the gas-liquid separating element 43 which comes into contact with ink faces downward to maintain the support table 82 at low temperature. Consequently, this wetted surface is unlikely to be affected by thermal transmission associated with infrared rays from the thermal fusion head 81 or convection. As a result, the liquid repellency of the gas-liquid separating element 43 can be restrained from being degraded.

Figure 16:
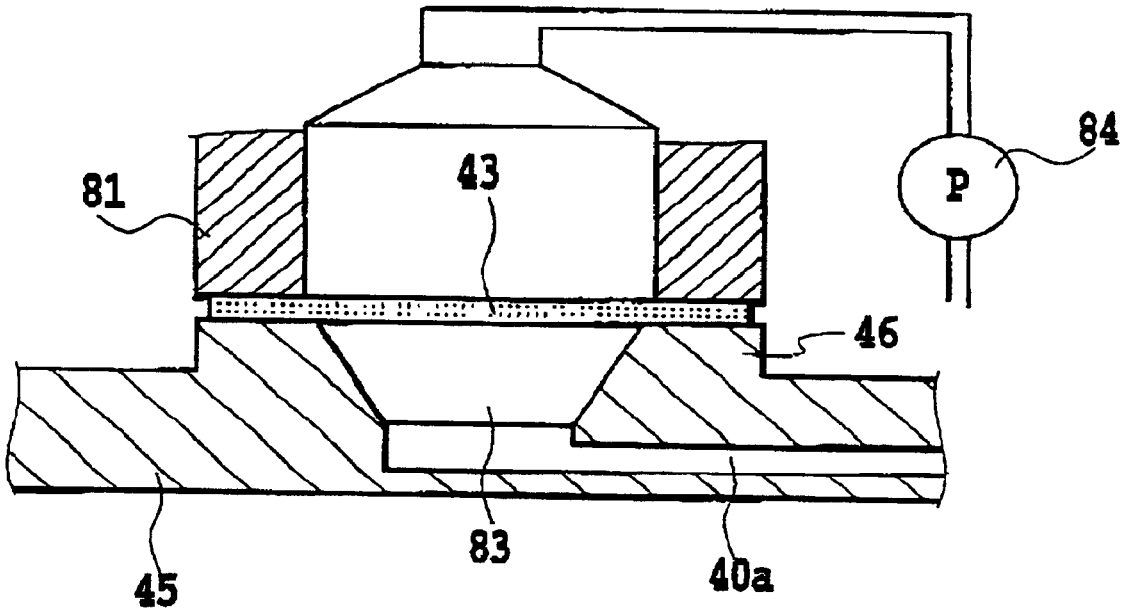
FIG. 16 is an operation conceptual drawing representing another embodiment of a manufacture method for a liquid tank according to the present invention.

In the embodiment shown in FIG. 16, the top surface plate 45 is partially formed into a ventilating opening 83. Reference numeral 43 denotes a gas-liquid separating element comprising a fluoroplastic. Reference numeral 81 denotes the thermal fusion head that is heated and pressed during thermal fusion. Reference numeral 84 denotes a pump that sucks air. The pump 84 is in communication with the inner surface of the cylindrical thermal fusion head in a sealed state. The shape of the outer circumference of the thermal fusion head is not only cylindrical but also can be polygonal.

During manufacture, the gas-liquid separating element 43 is set on the ventilating opening 83 in the top surface plate 45, and the heated thermal fusion head 81 is pressed against the gas-liquid separating element 43. Thus, the top surface plate 45 is partially fused on the gas-liquid separating element 43. In this case, if this operation is performed while sucking air from the interior of the thermal fusion head 81 using the pump 84, this prevents heated air around the heated thermal fusion head 81 from contacting with the gas-liquid separating element 43 to thereby increase its temperature. During the fusion operation, air is sucked via the common suction port in the storage ink tank and passes through the gas-liquid separating element to cool it.

Figure 17:
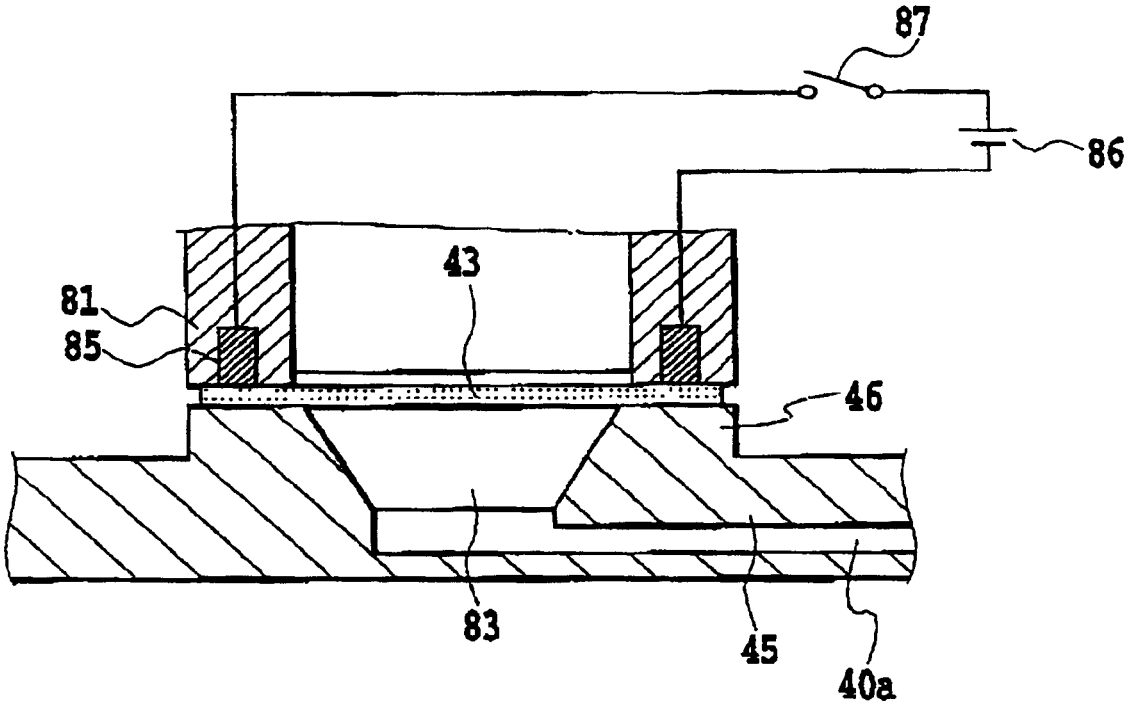
FIG. 17 is an operation conceptual drawing representing still another embodiment of a manufacture method for a liquid tank according to the present invention.

In the embodiment shown in FIG. 17, the top surface plate 45 is partially formed into a ventilating opening 83. Reference numeral 43 denotes a gas-liquid separating element comprising a fluoroplastic. Reference numeral 81 denotes the thermal fusion head that is heated and pressed during thermal fusion. Reference numeral 85 denotes a heater that generates heat when electricity is conducted therethrough. The heater 85 is embedded in the abutting surface of the tip portion of the thermal fusion head 81 so as to be partially exposed therefrom. Reference numeral 86 denotes a power supply that conducts electricity through the heater 85. Reference numeral 87 denotes an on/off switch that provides an electric connection to conduct electricity through the heater 85.

During manufacture, the gas-liquid separating element 43 is set on the ventilating opening 83 in the top surface plate 45, and the thermal fusion head 81 is pressed against the gas-liquid separating element 43. Then, the on-off switch 87 is turned on to conduct electricity through the heater 87. Thus, the temperature of the heater 85 instantaneously increases to partially fuse the gas-liquid separating element 43 on the top surface plate 45. When the on/off switch 87 is turned off to shut off the current, the heat from the heater 85 is radiated via the top surface plate 45 and the thermal fusion head 81, thereby rapidly reducing the temperature. As a result, the heater 85 and the thermal fusion head 81 are maintained at low temperature except during thermal fusion. Accordingly, the ventilation area of the gas-liquid separating element 43 is prevented from being exposed to high temperature owing to infrared radiation or convection. For a similar reason, it is effective to execute thermal fusion by the application of infrared laser beams.

Figure 18:
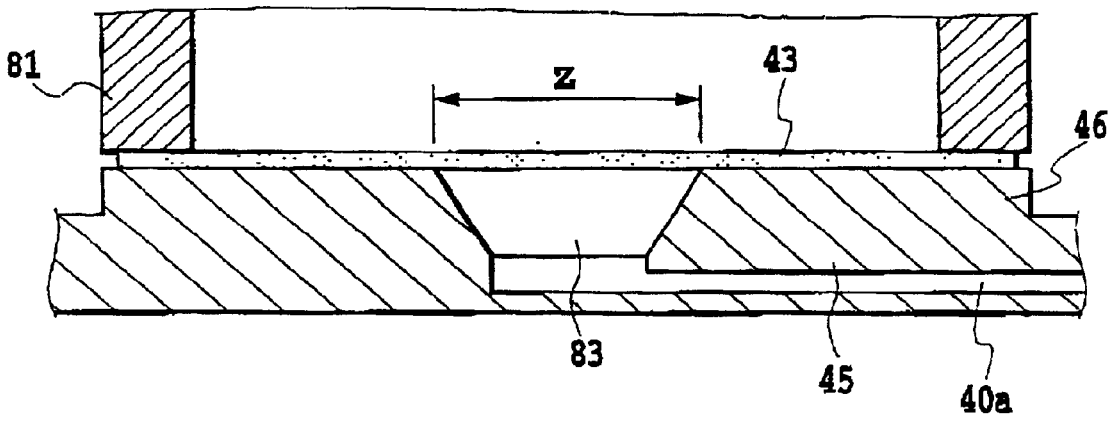
FIG. 18 is an operation conceptual drawing representing yet another embodiment of a manufacture method for a liquid tank according to the present invention.

In the embodiment shown in FIG. 18, the top surface plate 45 is partially formed into a ventilating opening 83. Reference numeral 43 denotes a gas-liquid separating element comprising a fluoroplastic. Reference numeral 81 denotes the thermal fusion head that is heated and pressed during thermal fusion. In this embodiment, an annular non-heated area is formed in the gas-liquid separating element between a potion thereof against which the tip portion of the thermal fusion head 81 abuts for fusion and a portion thereof facing the opening 83. By forming this non-heated area to sufficiently separate the tip portion of the thermal fusion head 81 from the opening 83 in the ink tank, a ventilation area Z of the gas-liquid separating element 43 is prevented from being degraded because of heat.

Figure 19:
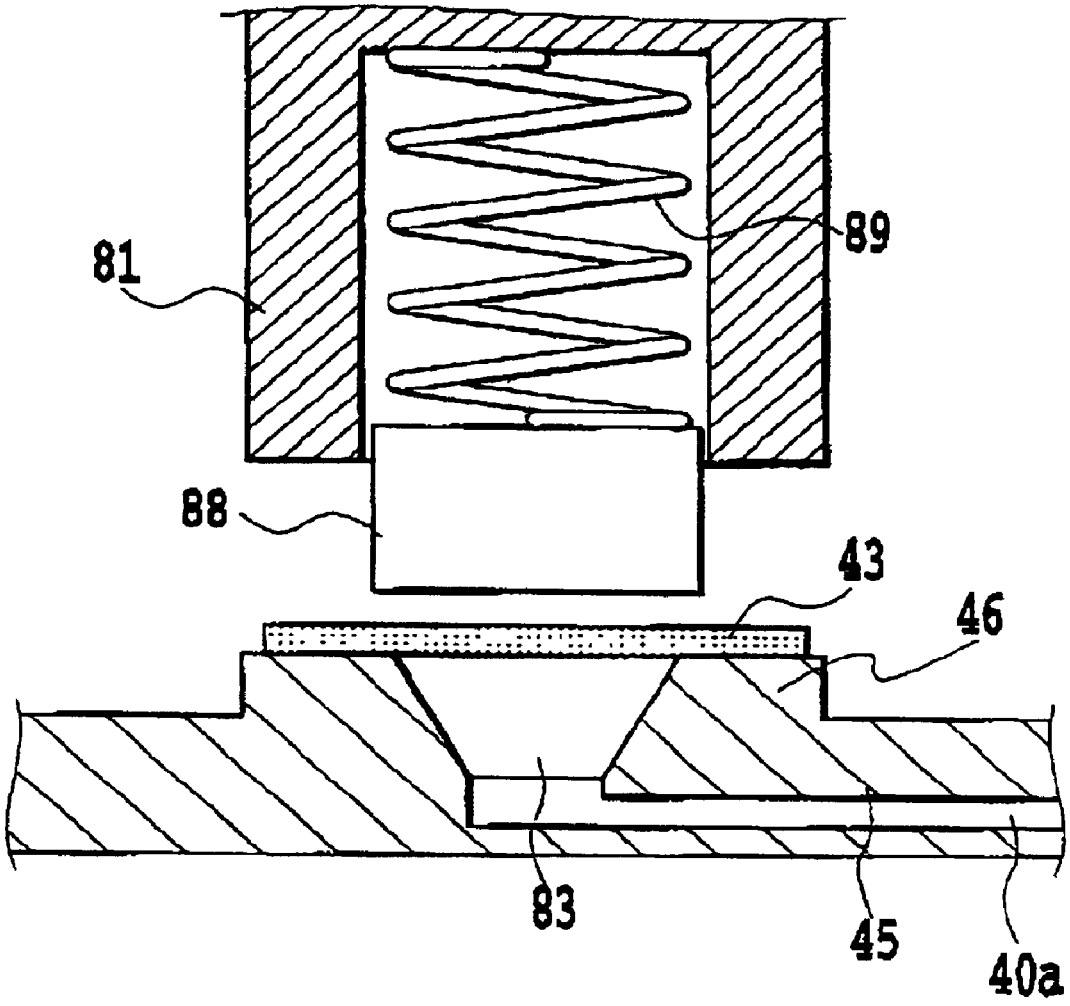
FIG. 19 is an operation conceptual drawing representing, in connection with FIG. 20, still another embodiment of a manufacture method for a liquid tank according to the present invention, and showing a state prior to junction.
Figure 20:
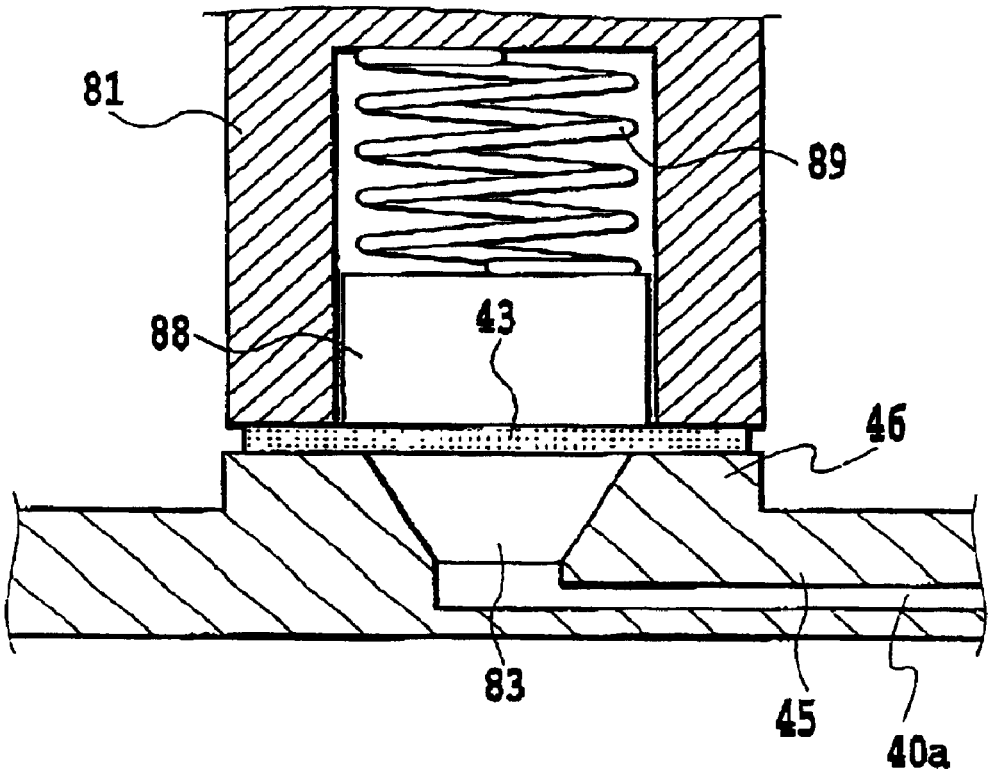
FIG. 20 is an operation conceptual drawing representing, in connection with FIG. 19, the above embodiment of a manufacture method for a liquid tank according to the present invention, showing a state during junction.

In the embodiment shown in FIGS. 19 and 20, the top surface plate 45 is partially formed into a ventilating opening 83. Reference numeral 43 denotes a gas-liquid separating element comprising a fluoroplastic. Reference numeral 81 denotes the thermal fusion head that is heated and pressed during thermal fusion. Reference numeral 88 denotes a heat insulating member that covers the gas-liquid separating element 43 during fusion. The heat insulating member 88 is stored in the thermal fusion head 81 so as to elevate and lower relative to the thermal fusion head 81. Reference numeral 89 denotes a spring that holds the heat insulating member 88.

Before the gas-liquid separating element 43 is fused as shown in FIG. 19, the spring 89 causes the heat insulating member 88 to protrude from the tip portion of the thermal fusion head 81. In contrast, while the gas-liquid separating element 43 is being fused as shown in FIG. 20, the heat insulating member 88 abuts against the surface of the ventilation area of the gas-liquid separating element 43 and is then pressed against the outer periphery of the gas-liquid separating element 43 so as to surround it. Thus, the gas-liquid separating element 43 is fused on part of the top surface plate 45. In this case, since the surface of the ventilation area of the gas-liquid separating element 43 is covered with the heat insulating member 88, the ventilation area of the gas-liquid separating element 43 is prevented from being exposed to high temperature owing to infrared radiation or heat convection.

Preferably, the heat insulating member 88 used in this embodiment sufficiently endures heat but does not transfer heat well. For example, a foamed member made of a heat resistant resin, ceramics, or the like can be used.

Figure 21:
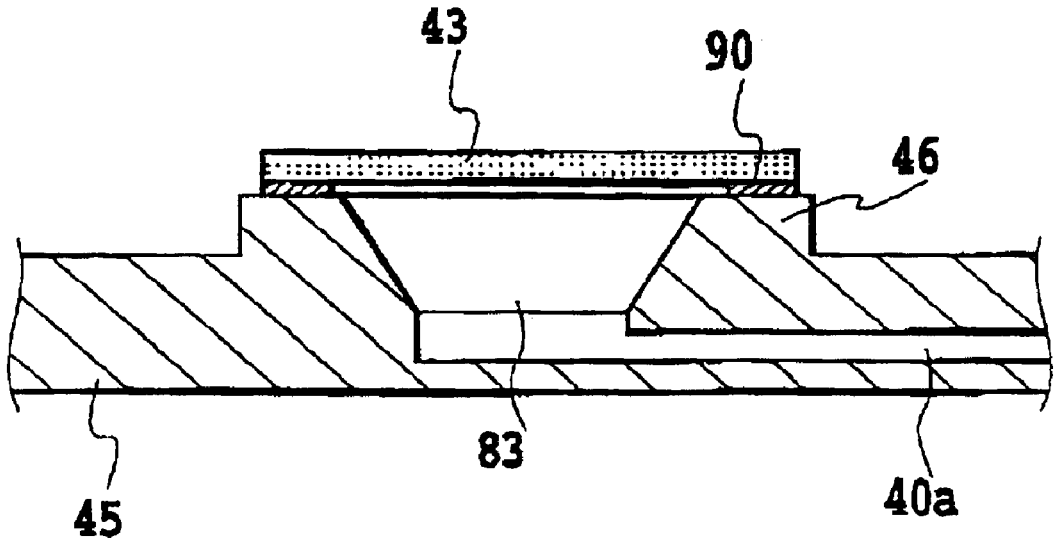
FIG. 21 is a sectional view of an essential part of a liquid tank, representing a different embodiment of a manufacture method for an ink tank according to the present invention.

In the embodiment shown in FIG. 21, the gas-liquid separating element 43 is fixed to the top surface plate 45 with an adhesive. Reference numeral 90 denotes a thermosetting adhesive or hot-melt adhesive applied to the top surface plate 45. This adhesive is applied to the periphery of the ventilation area in an annular form. Since each adhesive is selected such that it is hardened or melted at a temperature at which the ventilation are is not affected, the ventilation capability is restrained from being degraded because of the adhesion process.

Figure 22:
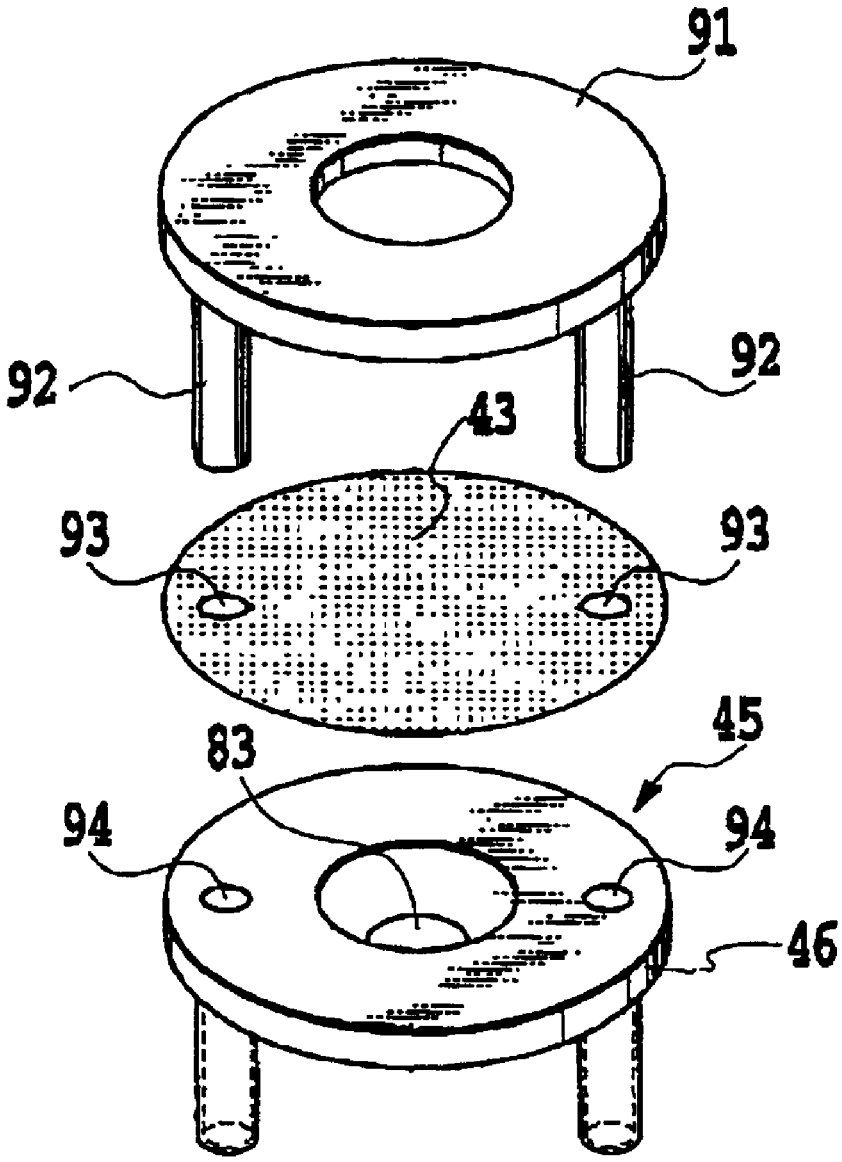
FIG. 22 is an exploded perspective view representing, in connection with FIG. 23, a further different embodiment of a manufacture method for an ink tank according to the present invention.
Figure 23:
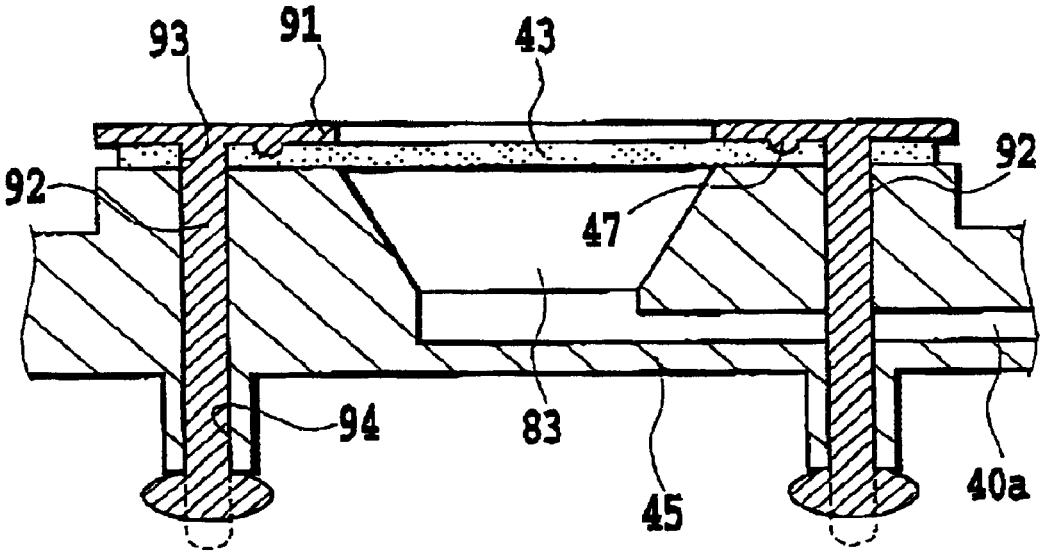
FIG. 23 is a sectional view of an essential part of a liquid tank, representing, in connection with FIG. 22, the above embodiment of a manufacture method for an ink tank according to the present invention.

In the embodiment shown in FIGS. 22 and 23, reference numeral 91 denotes a film presser ring made of a resin. The film presser ring 91 has a pair of boss portions 91 protrusively formed thereon and extending downwardly. The gas-liquid separating element 43 has a pair of positioning holes 93 that are penetrated by the corresponding boss portions 92. The top surface plate 45 has a pair of through-holes 94 that are penetrated by the corresponding boss portions 92. The boss portions 92 are passed through the corresponding through-holes 94, and their tips are heated and melted so as to be integrally engagingly locked on the top surface plate 45. That is, the pair of boss portions 92 of the presser member 44 are positioned by penetrating the positioning holes 93 in the gas-liquid separating element 43 and the through-holes 94 in the top surf ace plate 45. In this state, the tips of the boss portions 92 protrude from the opening ends of the through-holes 94. By heating and melting these protruding portions, the gas-liquid separating element 43 is fixed so as to be sandwiched between the presser member 44 and the top surface plate 45. The film presser ring 91 has a projecting portion 47 formed thereon and which abuts against and slightly cuts into the outer periphery of the gas-liquid separating element 43. This brings the film presser ring 91 and the gas-liquid separating element 43 into perfect tight contact with each other to prevent the leakage of ink.

The presence of the boss portions 92 allows the ventilation surface of the gas-liquid separating element 43 to be separated from a heat source by the corresponding distance, thereby restraining heat from being transferred to the ventilation surface of the gas-liquid separating element 43 when the tips of the boss portions 92 are melted. Thus, the liquid repellency of the gas-liquid separating element 43 is appropriately maintained.

Figure 24:
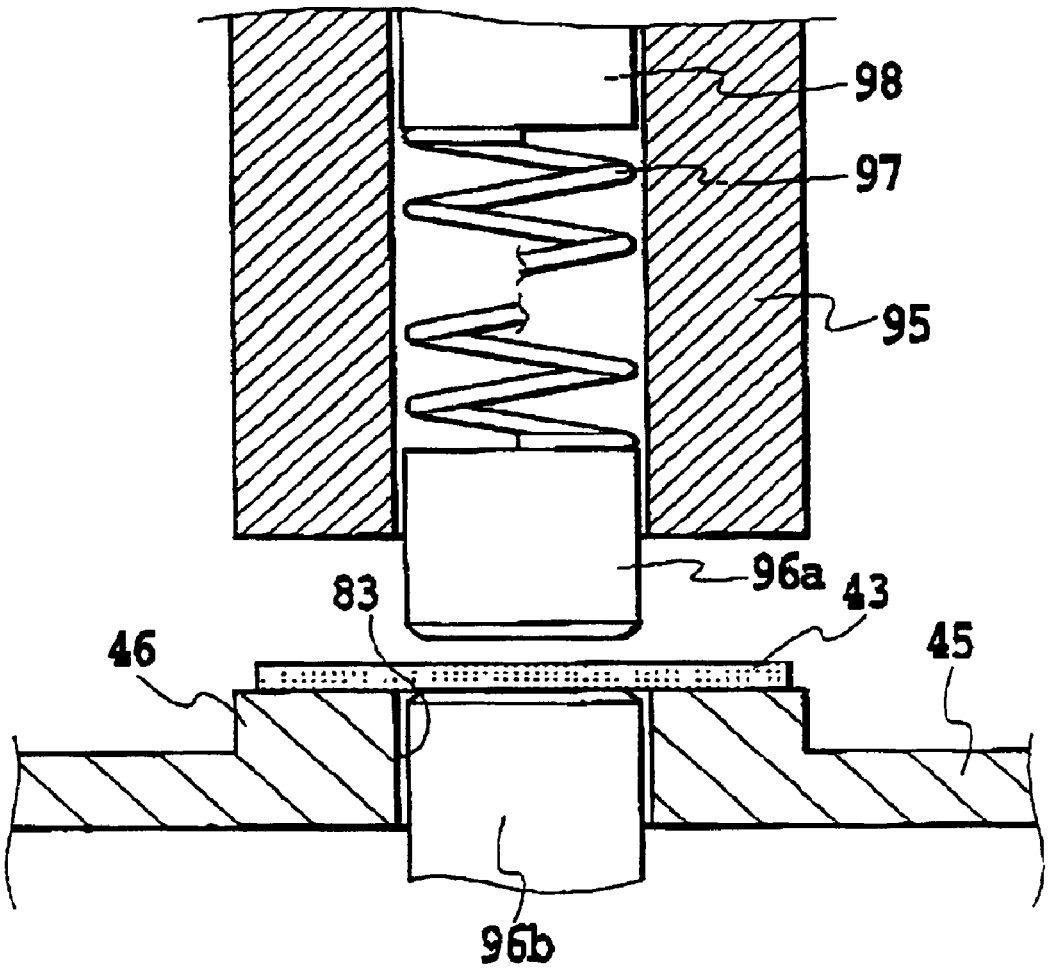
FIG. 24 is an operation conceptual drawing representing, in connection with FIG. 25, still another embodiment of a manufacture method for a liquid tank according to the present invention, and showing a state prior to junction.
Figure 25:
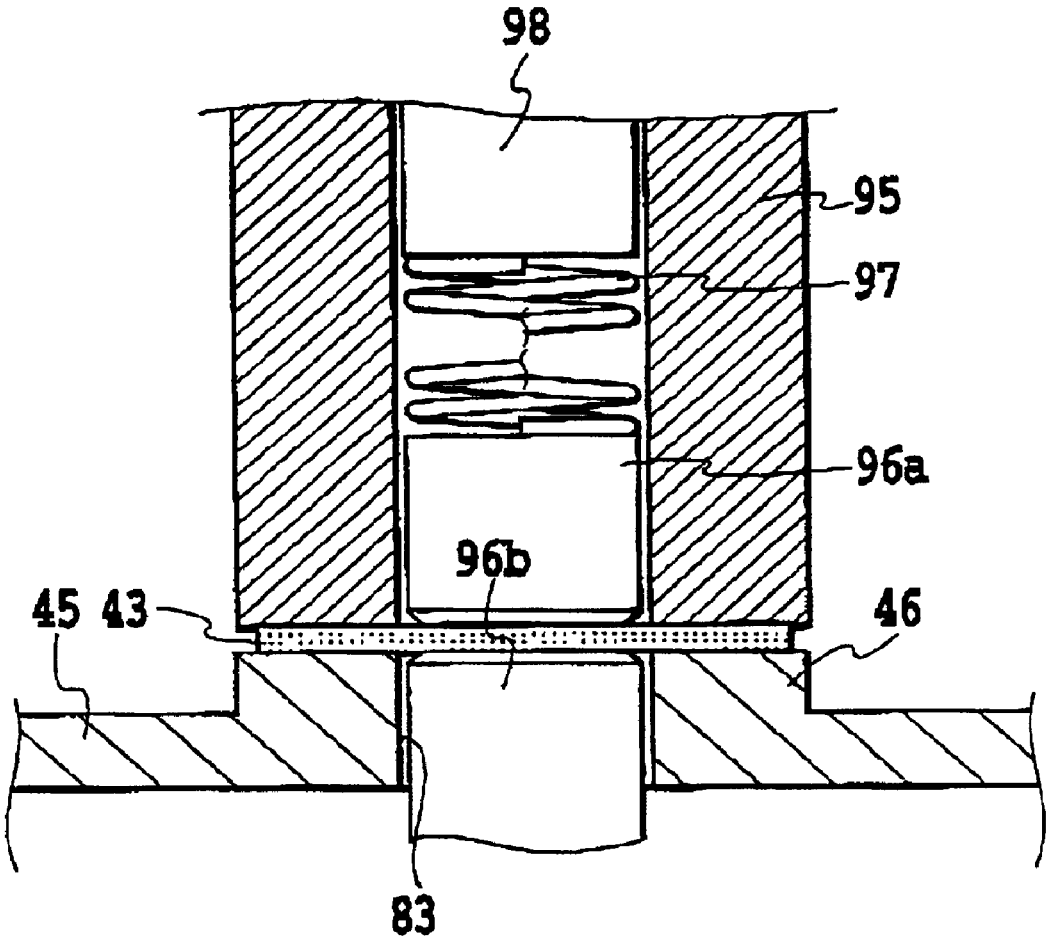
FIG. 25 is an operation conceptual drawing representing, in connection with FIG. 24, the above embodiment of a manufacture method for a liquid tank according to the present inventions showing a state during junction.

A method of fusing the gas-liquid separating element by ultrasonic bonding will be described with reference to FIGS. 24 and 25. In FIGS. 24 and 25, reference numeral 45 denotes a top surface plate with which the cover member 37 has not been integrated yet. The top surface plate 45 is partially formed into a ventilating opening 83. Reference numeral 43 denotes a gas-liquid separating element comprising a fluoroplastic. Reference numeral 95 denotes an ultrasonic bonding head that emits ultrasonic waves during ultrasonic bonding. Reference numerals 96*a* and 96*b*. Reference numerals 96*a* and 96*b* denote vibration isolating members that sandwich the ventilation area of the gas-liquid separating element 43 therebetween in the vertical direction. The material of the vibration isolating members 96*a* and 96*b* may be metal or a resin. One 96*a* of the vibration isolating members is stored in the ultrasonic bonding head 95 so as to elevate and lower relative to the cylindrical ultrasonic bonding head 95. Reference numeral 97 denotes a spring that holds the vibration isolating member 96*a*. Reference numeral 98 denotes a holding member that fixes the spring 97. The other vibration isolating member 96*b* is positioned so as to be fitted in the opening 83 with its tip surface abutting against the back surface of the gas-liquid separating element 43.

As shown in FIG. 24, before fusions the spring 97 causes the vibration isolating member 96*a* to protrude from the tip portion of the ultrasonic bonding head 95. As shown in FIG. 25, during fusion, the vibration isolating members 96*a* and 96*b* sandwich the ventilation area of the gas-liquid separating element 43 therebetween from the opposite sides, and the ultrasonic bonding head 95 is pressed against the outer periphery of the gas-liquid separating element 43 to surround it. Then, ultrasonic vibration is imparted to part of the top surface plate 45 and the gas-liquid separating element 43 to generate friction heat, which then causes the top surface plate 45 and the gas-liquid separating element 43 to be jointed to each other. In this case, since the ventilation area of the gas-liquid separating element 43 has its opposite surfaces held by the vibration isolating members 96*a* and 96*b*, ultrasonic vibration is not transmitted during fusion. At the same time, the ventilation area of the gas-liquid separating element 43 is prevented from being deformed and bent during ultrasonic bonding.

The present invention is not limited to the above described field of ink jet apparatuses. The construction disclosed in the present invention is applicable to the case in which a gas-liquid separating element is preferably attached to a location such as a communication section that allows the interior and exterior of electric or electronic equipment to communicate with each other, or an operative section in which water may infiltrate into a switch or button. Therefore, failures associated with the infiltration of water are prevented.

The present invention achieves distinct effect when applied to the liquid ejecting head, the head cartridge, or the image printing apparatus which has means for generating thermal energy such as electrothermal transducers or laser beam, and which causes changes in ink by the thermal energy so as to eject liquid. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid, and operates as follows: first, one or more driving signals are applied to the electrothermal transducers to cause thermal energy corresponding to printing information; second, the thermal energy induces sudden temperature rise that exceeds the nucleate boiling so as to cause the film boiling on heating portions of the liquid ejecting head; and third, bubbles are grown in the liquid corresponding to the driving signals. By using the growth and collapse of the bubbles, the ink is expelled from at least one of the ejecting ports of the head to form one or more liquid drops. The driving signal in the form of a pulse is preferable because the growth and collapse of the bubbles can be achieved instantaneously and suitably by this form of driving signal. As the driving signal in the form of a pulse, those described in U.S. Pat. Nos. 4,463,359 and 4,345,262 are preferable.

In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a liquid ejecting head, which is incorporated to the present invention: this structure includes heating portions disposed on bent portions in addition to a combination of the ejecting ports, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejecting ports of the electrothermal transducers, and the latter discloses a structure in which openings for absorbing pressure waves caused by thermal energy are formed corresponding to the ejecting ports. Thus, irrespective of the type of the liquid ejecting head, the present invention can achieve printing positively and effectively.

The present invention can be also applied to a so-called full-line type liquid ejecting head whose length equals the maximum width across a printing medium. Such a liquid ejecting head may consists of a plurality of liquid ejecting heads combined together, or one integrally arranged liquid ejecting head.

In addition, the present invention can be applied to various serial type liquid ejecting heads: a liquid ejecting head fixed to the main assembly of an image printing apparatus; a conveniently replaceable chip type liquid ejecting head which, when loaded on the main assembly of an image printing apparatus, is electrically connected to the main assembly, and is supplied with liquid therefrom; and a cartridge type liquid ejecting head integrally including a liquid reservoir.

It is further preferable to add a recovery system for ejecting liquid from the ejecting head in adequate condition, or a preliminary auxiliary system for a liquid ejecting head as a constituent of the image printing apparatus because they serve to make the effect of the present invention more reliable. Examples of the recovery system are a capping means and a cleaning means for the liquid ejecting head, and a pressure or suction means for the liquid ejecting head. Examples of the preliminary auxiliary system are a preliminary heating means utilizing electrothermal transducers or a combination of other heater elements and the electrothermal transducers, and a means for carrying out preliminary ejection of liquid independently of the ejection for printing. These systems are effective for reliable printing.

The number and type of liquid ejecting heads to be attached on an image printing apparatus can be also detached. For example, only one liquid ejecting head corresponding to a single color ink, or a plurality of liquid ejecting heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, the treatment liquid (the printablity enhanced liquid) for adjusting the printablity of the ink may also be ejected from each individual heads or a common ejecting head to the printing medium in accordance with a kind of the printing medium or the printing mode.

Furthermore, although the above-described embodiments use liquids, liquids that are liquid when the printing signal is applied can be used: for example, liquids can be employed that solidify at a temperature lower than the room temperature and are softened or liquefied in the room temperature. This is because in the ink jet system, the liquid is generally temperature adjusted in a range of 30° C. to 70° C. so that the viscosity of the liquid is maintained at such a value that the liquid can be ejected reliably. In addition, the present invention can be applied to such apparatus where the liquid is liquefied just before the ejection by the thermal energy as follows so that the liquid is expelled from the ports in the liquid state, and then begins to solidify on hitting the printing medium, thereby preventing the liquid evaporation; the liquid is transformed from solid to liquid state by positively utilizing the thermal energy which would otherwise cause the temperature rise; or the liquid, which is dry when left in air, is liquefied in response to the thermal energy of the printing signal. In such cases, the liquid may be retained in recesses or through holes formed in a porous sheet as liquid or solid substances so that the liquid faces the electrothermal transducers as described in Japanese Patent Application Laying-open Nos. 54-56847 (1979) or 60-71260 (1985). The present invention is most effective when it uses the film boiling phenomenon to expel the liquid.

Furthermore, the image printing apparatus in according to the present invention can be employed not only as an image output terminal of an information processing device such as a computer, but also as an output device of a copying machine combining with a reader or the like, a facsimile apparatus having a transmission and receiving function, or printing press for cloth. A sheet or web paper, a wooden or plastic board, a stone slab, a plate glass, metal sheet, a three dimensional structure or the like may be used as the printing medium in according to the present invention.

The present invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. An apparatus for manufacturing a structure having a gas-liquid separating element for allowing a gas to pass therethrough while blocking passage of a liquid, and an opening which is blocked by mounting the gas-liquid separating element so as to close the opening, the apparatus comprising:

an energy supplying head for supplying the energy to a joined portion between an outer peripheral portion of the opening of the structure and the gas-liquid separating element so as to close the opening; and restricting means for restricting the energy transfer from the energy supplying head to a working portion of the gas-liquid separating element so that the working portion is unaffected by the energy generated from the energy supplying head, wherein the working portion faces the opening, passes gas therethrough, and blocks passage of the liquid.

2. An apparatus according to claim 1, wherein the energy supplying head is a thermal head for generating heat, wherein said energy supplying head has an annular hollow construction so as to allow only the joined portion of the gas-liquid separating element to be heated.

3. An apparatus according to claim 2, further comprising means for avoiding heat from the thermal head, the means for avoiding the heat being placed on the opposite side of the thermal head via the gas-liquid separating element and being made of metal for absorbing heat of the thermal head from the g as-liquid separating element is joined to the structure.

4. An apparatus according to claim 2, further comprising means for avoiding heat from the thermal head, said means for avoiding the heat having an annular exhaust construction for absorbing heat from an annular hollow portion of the thermal head having the annular construction when the gas-liquid separating element is joined to the structure.

5. An apparatus according to claim 2, further comprising means for avoiding heat from the thermal head, said means for avoiding the heat having a heat insulation member for preventing a heat transfer by touching with the working portion of the gas-liquid separating element and being placed within an annular hollow portion of the thermal head having the annular construction when the gas-liquid separating element is joined to the structure.

6. An apparatus according to claim 2, further comprising a support member for supporting the gas-liquid separating element at the opening of the structure, the thermal head applying heat from the opposite side of the support member to the outer peripheral portion of the opening of the structure.

7. An apparatus according to claim 6, wherein the support member is made of metal.

8. An apparatus according to claim 2, wherein said thermal head has a larger inner diameter than the opening of the structure.

9. An apparatus according to claim 2, wherein the thermal head incorporates a heater only in a tip portion thereof which comes into contact with the joined portion of the gas-liquid separating element so that only a portion of the gas-liquid separating element is heated.

10. An apparatus according to claim 1, wherein the energy supplying head is an ultrasonic head generating ultrasonic vibration, wherein the ultrasonic head has an annular hollow construction corresponding to the joined portion of the gas-liquid separating element.

11. A apparatus according to claim 10, further comprising means for avoiding an ultrasonic vibration from the ultrasonic head, said means for avoiding the ultrasonic vibration having a vibration insulating member for preventing transmission of vibration by touching with the working portion of the gas-liquid separating element and being placed within a hollow portion of the annular ultrasonic head when the gas-liquid separating element is joined to the structure.

12. A apparatus according to claim 1, wherein a thermosetting adhesive or a hot-melt adhesive is applied on the joined portion between the outer peripheral portion of the opening of the structure and the gas-liquid separating element.

13. An apparatus according to claim 1, wherein the energy supplying head includes a laser for applying a laser beam to the joined portion only so as to thermally bond the gas-liquid separating element with the outer peripheral portion of the opening of the structure.

14. A method for manufacturing a structure comprising a gas-liquid separating element for allowing a gas to pass therethrough while blocking passage of a liquid, and an opening which is blocked by mounting the gas-liquid separating element so as to close the opening, the method comprising the steps of:

supplying an energy for joining a joined portion between the portion of the structure surrounding the opening of the structure and the gas-liquid separating element so as to close the opening; and restricting the applied energy to a working portion of the gas-liquid separating element so that the working portion is unaffected by the energy generated from the energy supplying head, the working portion facing the opening, passing the gas therethrough, and blocking passage of the liquid.

15. A method according to claim 14, wherein the step of supplying the energy is carried out using a thermal head for applying heat, and wherein the step of restricting the applied energy eliminates heat from the working portion of the gas-liquid separating element, or insulates the heat from the thermal head so that the heat is prevented from transferring to the working portion of the gas-liquid separating element.

16. A method according to claim 15, wherein the step for supplying the energy is carried out using an ultrasonic head for generating ultrasonic vibration, and wherein the step of restricting the applied energy insulates the vibration from the ultrasonic head so that the vibration is prevented from transferring to the working portion of the gas-liquid separating element.

17. A structure having a gas-liquid separating element for allowing a gas to pass therethrough while blocking passage of a liquid, and an opening which is blocked by mounting the gas-liquid separating element so as to close the opening, wherein:

the gas-liquid separating element is divided into a joined portion and a working portion, wherein said joined position is joined with an outer peripheral portion of the opening of the structure so as to close the opening, wherein said working portion faces the opening, passes the gas therethrough, and blocks passage of the liquid, and wherein said joined portion is supplied with energy for welding with an outer peripheral portion of the opening of the structure so that the working portion of the gas-liquid separating element is joined to the structure by using a manufacturing apparatus which comprises means for avoiding the energy, the means for avoiding the energy being not affected by the energy applied to the joined portion.

18. A structure according to claim 17, wherein the gas-liquid separating element undergoes liquid repellancy treatment.

19. A structure having a gas-liquid separating element for allowing a gas to pass therethrough while blocking passage of a liquid, and an opening which is blocked by mounting the gas-liquid separating element so as to close the opening, the structure, the gas-liquid separating element being divided into a joined portion which is joined with an outer peripheral portion of the opening of the structure so as to close the opening and a working portion which faces the opening, passes the gas therethrough, and blocks passage of the liquid, the structure further comprising:

a pressing member for pressing the gas-liquid separating element against the structure, the pressing member having a plurality of bosses which are engaged with other openings provided independently of the opening of the structure so that the gas-liquid separating element is mounted with the structure by deforming the bosses of the pressing member.

20. A structure according to claim 19, wherein the gas-liquid separating element undergoes liquid repellency treatment.

21. A liquid tank, comprising:

a negative pressure introducing section for introducing negative pressure into the liquid tank;

a liquid intake section for taking a liquid in the liquid tank by the negative pressure introduced from the negative pressure introducing section; and a gas-liquid separating element for passing through only a gas, the gas-liquid separating element being disposed in the negative pressure introducing section;

wherein the gas-liquid separating element is constructed such that the gas is allowed to pass therethrough while the liquid is prevented from passing therethrough, and the negative pressure introducing section has an opening to which the gas-liquid separating element is mounted so as to close the opening, and wherein the gas-liquid separating element is divided into a joined portion which is joined with an outer peripheral portion of the opening of the structure so as to close the opening, and a working portion which faces the opening, passes the gas therethrough, and blocks passage of the liquid, the joined portion being supplied with the energy for welding with the outer peripheral portion of the opening of the structure so that the working portion of the gas-liquid separating element is joined with the structure by using a manufacturing apparatus which comprises means for avoiding the energy, the means for avoiding the energy being not affected by the energy applied to the joined portion.

22. A structure according to claim 21, wherein the gas-liquid separating element undergoes liquid repellency treatment.

23. A liquid tank comprising a container body for storing a liquid, an opening through which the liquid is taken out, an atmosphere communication port for communicating with atmospheric air, and a gas-liquid separating element for allowing a gas to pass therethrough, the gas-liquid separating element being disposed in the atmosphere communication port, wherein the gas-liquid separating element is constructed such that the gas is allowed to pass therethrough while the liquid is prevented from passing therethrough, and the negative pressure introducing section has an opening to which the gas-liquid separating element is mounted so as to close the opening, and wherein the gas-liquid separating element is divided into a joined which is joined to an outer peripheral portion of the opening of the structure so as to close the opening, and a working portion which faces the opening, passed the gas therethrough, and blocks passage of the liquid, the joined portion being supplied with the energy for welding with the outer peripheral portion of the opening so that the working portion of the gas-liquid separating element is joined to the structure by using a manufacturing apparatus which comprises means for avoiding the energy, the means for avoiding the energy being not affected by the energy applied to the joined portion.

24. A structure according to claim 23, wherein the gas-liquid separating element undergoes liquid repellency treatment.

* * * * *

UNITED STATES PATENT AND TRADEMARK OFFICE

CERTIFICATE OF CORRECTION

PATENT NO. : 6,830,321 B2
DATED : December 14, 2004
INVENTOR(S) : Hideaki Okamoto et al.

It is certified that error appears in the above-identified patent and that said Letters Patent is hereby corrected as shown below:

Title page,
Item [57], ABSTRACT,
Line 12, “he” should read -- the --.

Column 15,
Line 5, “head” should read -- head with --.

Column 16,
Line 54, “inventions” should read -- invention, --; and
Line 64, “for the” should read -- forth --.

Column 18,
Line 23, “does out” should read -- does --.

Column 20,
Line 16, “shows)” should read -- shown) --; and
Line 57, “the a” should read -- the a --.

Column 26,
Line 25, “are” should be deleted.

Column 27,
Line 5, “Reference numerals **96*a* and 96*b*.**” should be deleted; and
Line 19, “fusions” should read -- fusion, --.

Column 30,
Line 17, “g as-liquid” should read -- gas-liquid --, and “element” should read -- element by contacting the gas-liquid separating element when the gas-liquid separating element --.

UNITED STATES PATENT AND TRADEMARK OFFICE

CERTIFICATE OF CORRECTION

PATENT NO. : 6,830,321 B2
DATED : December 14, 2004
INVENTOR(S) : Hideaki Okamoto et al.

It is certified that error appears in the above-identified patent and that said Letters Patent is hereby corrected as shown below:

Column 32,
Line 51, “a joined” should read -- a joined portion --; and
Line 54, “passed” should read -- passes --.

Signed and Sealed this

Seventh Day of March, 2006

JON W. DUDAS
*Director of the United States Patent and Trademark Office*